US010054901B1

(12) United States Patent
Fukamachi

(10) Patent No.: US 10,054,901 B1
(45) Date of Patent: Aug. 21, 2018

(54) DEVELOPING CARTRIDGE INCLUDING FIRST GEAR, SECOND GEAR, AND PROTRUSION MOVABLE TOGETHER WITH SECOND GEAR

(71) Applicant: BROTHER KOGYO KABUSHIKI KAISHA, Nagoya-shi, Aichi-ken (JP)

(72) Inventor: Yasuo Fukamachi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/719,713

(22) Filed: Sep. 29, 2017

(30) Foreign Application Priority Data

Mar. 30, 2017 (JP) ..... 2017-067698

(51) Int. Cl.
*G03G 21/16* (2006.01)

(52) U.S. Cl.
CPC ..... *G03G 21/1647* (2013.01); *G03G 21/1676* (2013.01)

(58) Field of Classification Search
CPC ..... G03G 21/1647; G03G 21/1676
See application file for complete search history.

(56) References Cited

U.S. PATENT DOCUMENTS

2008/0223173 A1 8/2008 Ishikawa et al.
2008/0205911 A1 9/2008 Ishikawa
2011/0236062 A1 9/2011 Takagi
2012/0195634 A1 8/2012 Kuriki
2013/0272724 A1 10/2013 Ukai
2015/0117873 A1* 4/2015 Mori ..... G03G 21/1857 399/12
2015/0192880 A1* 7/2015 Noda ..... G03G 15/0889 399/12

(Continued)

FOREIGN PATENT DOCUMENTS

JP 2008-216393 A 9/2008
JP 2011-203362 A 10/2011

(Continued)

OTHER PUBLICATIONS

International Search Report and Written Opinion issued in related international application PCT/JP2017/035587 dated Nov. 21, 2017.

(Continued)

*Primary Examiner* — Walter L Lindsay, Jr.
*Assistant Examiner* — Jessica L Eley
(74) *Attorney, Agent, or Firm* — Merchant & Gould P.C.

(57) ABSTRACT

A developing cartridge includes a first gear, a second gear rotatable with rotation of the first gear, and a first protrusion movable together with the second gear. The first gear includes a first gear portion and a second gear portion having an addendum circle greater than that of the first gear portion. The second gear includes a third gear portion and a fourth gear portion having an addendum circle smaller than that of the third gear portion. During rotation of the second gear from a first rotational position to a second rotational position, the third and fourth gear portions move from a first position where the first and third gear portions engage with each other but the second and fourth gear portions do not to a second position where the second and fourth gear portions engage with each other but the first and third gear portions do not.

27 Claims, 20 Drawing Sheets

(56) References Cited

U.S. PATENT DOCUMENTS

| | | | | |
|---|---|---|---|---|
| 2015/0198921 | A1* | 7/2015 | Koyama | G03G 15/2089 399/329 |
| 2015/0277353 | A1 | 10/2015 | Fukamachi | |
| 2015/0277355 | A1 | 10/2015 | Taguchi | |
| 2017/0261915 | A1* | 9/2017 | Abe | G03G 21/1647 |

FOREIGN PATENT DOCUMENTS

| | | | |
|---|---|---|---|
| JP | 2012-155262 | A | 8/2012 |
| JP | 2015-197536 | A | 11/2015 |

OTHER PUBLICATIONS

Extended European Search Report issued in related European Patent Application 17193939.0, dated Mar. 1, 2018.

* cited by examiner

DEVELOPING CARTRIDGE INCLUDING FIRST GEAR, SECOND GEAR, AND PROTRUSION MOVABLE TOGETHER WITH SECOND GEAR

CROSS REFERENCE TO RELATED APPLICATION

This application claims priority from Japanese Patent Application No. 2017-067698 filed Mar. 30, 2017. The entire content of the priority application is incorporated herein by reference.

TECHNICAL FIELD

The present disclosure relates to a developing cartridge used for an image forming apparatus.

BACKGROUND

There have been known image forming apparatuses including developing cartridges. One of such image forming apparatuses is configured to identify the specification of the developing cartridge or determine whether or not the developing cartridge is attached. For example, a prior art discloses a developing cartridge including a detection gear and protrusions moving together with rotation of the detection gear. In this configuration, an image forming apparatus senses the protrusions by means of a sensor to detect whether the developing cartridge is attached.

SUMMARY

In a case where the image forming apparatus is configured to identify the specification of the developing cartridge by detecting the protrusions thereof, the arrangement patterns of the protrusions are made different for each of a plurality of specifications. This enables the image forming apparatus to identify a developing cartridge having a specific specification from among the plurality of specifications.

In recent years, there is a demand to diversify motions of gear structures of the developing cartridges in response to diversification of the specifications of the developing cartridges.

It is therefore an object of the disclosure to provide a developing cartridge in which motion of a gear structure can be diversified in response to diversification of the specifications of the developing cartridges.

In order to attain the above and other objects, according to one aspect, the disclosure provides a developing cartridge including a casing, a first gear, a second gear, and a first protrusion. The casing is configured to accommodate therein developing agent. The first gear is rotatable about a first axis extending in a first direction. The first gear is positioned at an outer surface of the casing. The first gear includes a first gear portion and a second gear portion. The first gear portion has an addendum circle. The second gear portion is positioned at a position different from a position of the first gear portion in the first direction. The second gear portion has an addendum circle greater than the addendum circle of the first gear portion. The second gear is rotatable about a second axis extending in the first direction. The second gear is rotatable from a first rotational position to a second rotational position with rotation of the first gear. The second gear is positioned at the outer surface. The second gear includes a third gear portion and a fourth gear portion. The third gear portion is engageable with the first gear portion and has an addendum circle. The fourth gear portion is engageable with the second gear portion. The fourth gear portion is positioned at a position different from a position of the third gear portion in the first direction. The fourth gear portion has an addendum circle smaller than the addendum circle of the third gear portion. The first protrusion protrudes in the first direction and is movable together with the second gear. The third gear portion and the fourth gear portion are movable relative to the casing from a first position to a second position during rotation of the second gear from the first rotational position to the second rotational position. In a case where the third gear portion and the fourth gear portion are positioned at the first position, the first gear portion and the third gear portion engage with each other and the second gear portion and the fourth gear portion do not engage with each other. In a case where the third gear portion and the fourth gear portion are positioned at the second position, the second gear portion and the fourth gear portion engage with each other and the first gear portion and the third gear portion do not engage with each other.

BRIEF DESCRIPTION OF THE DRAWINGS

The particular features and advantages of the disclosure will become apparent from the following description taken in connection with the accompanying drawings, in which.

DETAILED DESCRIPTION

A developing cartridge according to a first embodiment of the present disclosure will be descried in detail with reference to the accompanying drawings.

First, a laser printer 1 to which a developing cartridge 10 as an example of the developing cartridge according to the first embodiment is detachably attachable will be described.

Figure 1:
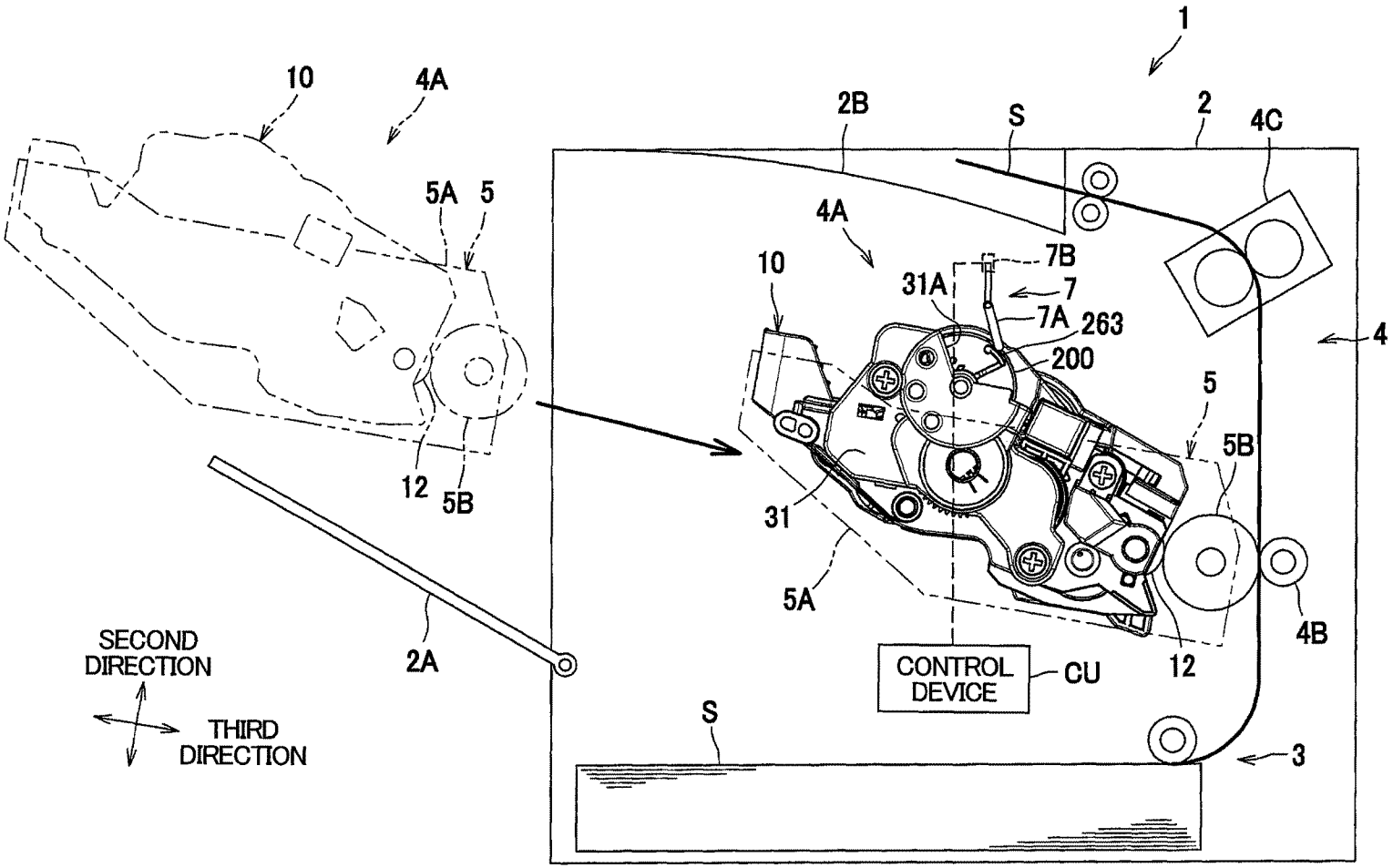
FIG. 1 is a schematic diagram illustrating a configuration of an image forming apparatus including a developing cartridge according to a first embodiment of the present disclosure.

As illustrated in FIG. 1, the laser printer 1 as an example of an image forming apparatus mainly includes a main body housing 2, a sheet supply portion 3, an image forming portion 4, and a control device CU.

The main body housing 2 includes a front cover 2A and a sheet discharge tray 2B positioned at the upper portion of the main body housing 2. The main body housing 2 is internally provided with the sheet supply portion 3 and the image forming portion 4. In a state where the front cover 2A is opened, the developing cartridge 10 is detachably attached to the laser printer 1.

The sheet supply portion 3 accommodates sheets of paper S. The sheet supply portion 3 supplies the sheets S one by one to the image forming portion 4.

The image forming portion 4 includes a process cartridge 4A, an exposure device (not illustrated), a transfer roller 4B, and a fixing device 4C.

The process cartridge 4A includes a photosensitive cartridge 5, and the developing cartridge 10. The developing cartridge 10 is attachable to and detachable from the photosensitive cartridge 5. In a state where the developing cartridge 10 is attached to the photosensitive cartridge 5, the developing cartridge 10 is attached to and detached from, as the process cartridge 4A, the laser printer 1.

The photosensitive cartridge 5 includes a frame 5A and a photosensitive drum 5B rotatably supported by the frame 5A.

Figure 2:
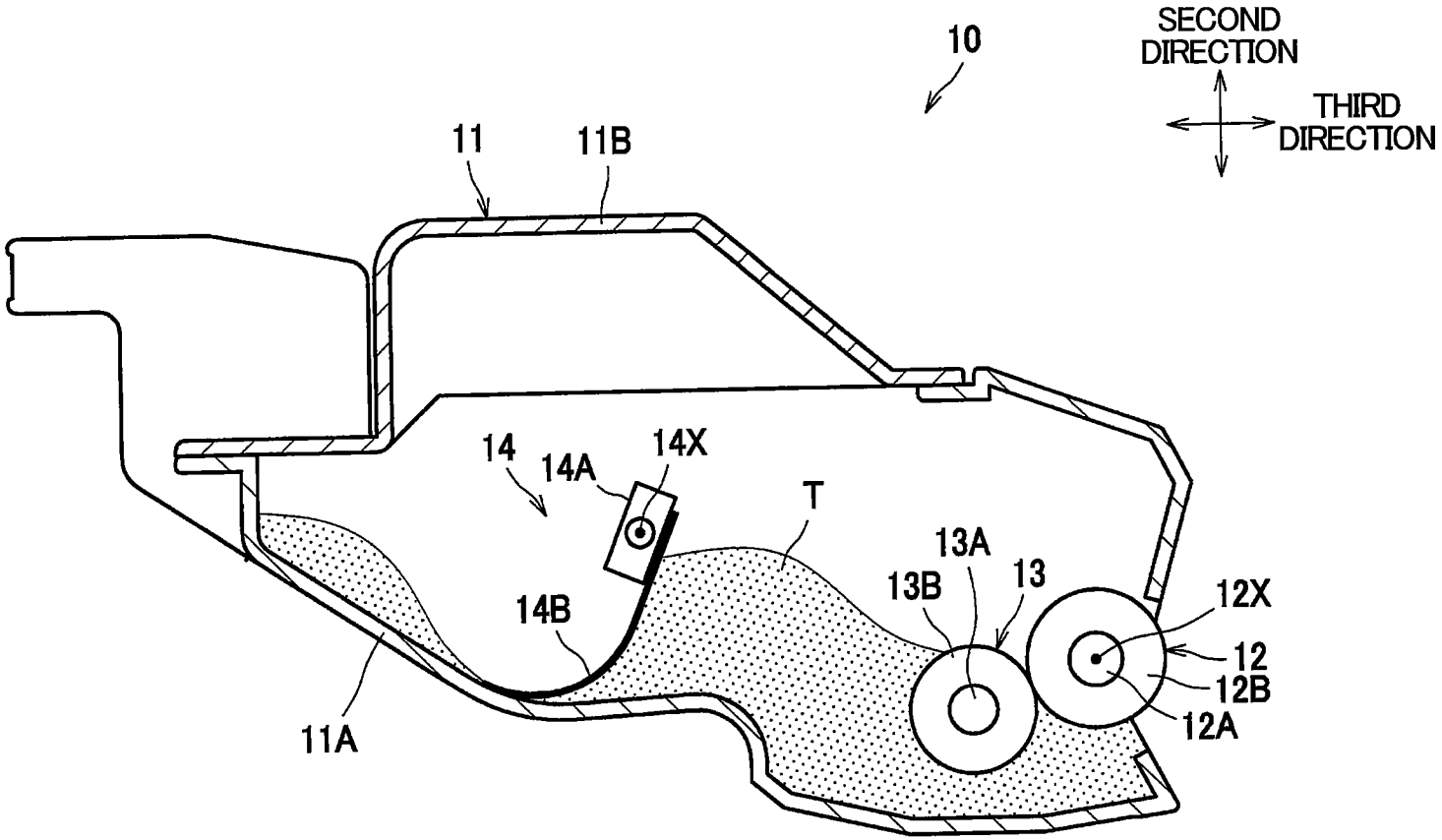
FIG. 2 is a cross-sectional view illustrating a configuration of the developing cartridge.

As illustrated in FIG. 2, the developing cartridge 10 includes a casing 11, a developing roller 12, a supply roller 13, and an agitator 14.

The casing 11 includes a container 11A and a lid 11B. The container 11A of the casing 11 is configured to accommodate therein toner T. The toner T is an example of developing agent.

The developing roller 12 includes a developing roller shaft 12A extending in a first direction and a roller portion 12B. The first direction is identical to an axial direction of a second agitator gear 100 (described later). Hereinafter, the first direction is also simply referred to as the axial direction. The roller portion 12B covers the outer circumferential surface of the developing roller shaft 12A. The roller portion 12B is made of, for example, electrically conductive rubber.

The developing roller 12 is rotatable about the developing roller shaft 12A. In other words, the developing roller 12 is rotatable about a third axis 12X extending in the first direction. The developing roller 12 is supported by the casing 11 so as to be rotatable about the developing roller shaft 12A. That is, the roller portion 12B is rotatable together with the developing roller shaft 12A. The developing roller 12 is applied with a developing bias by the control device CU.

The container 11A and the lid 11B of the casing 11 face each other in a second direction. The second direction crosses the first direction. Preferably, the second direction is orthogonal to the first direction. The developing roller 12 is positioned at one end portion of the casing 11 in a third direction. The third direction crosses the first direction and the second direction. Preferably, the third direction is orthogonal to both the first direction and the second direction.

The supply roller 13 includes a supply roller shaft 13A extending in the first direction and a roller portion 13B. The roller portion 13B covers the outer circumferential surface of the supply roller shaft 13A. The roller portion 13B is made of, for example, sponge. The supply roller 13 is rotatable about the supply roller shaft 13A. That is, the roller portion 13B is rotatable together with the supply roller shaft 13A.

The agitator 14 includes an agitator shaft 14A and a flexible sheet 14B. The agitator shaft 14A is an example of a shaft. The agitator shaft 14A extends in the first direction. The agitator shaft 14A is rotatable about a first axis 14X extending in the first direction. The agitator shaft 14A is supported by the casing 11 so as to be rotatable about the first axis 14X. That is, the agitator 14 is rotatable about the first axis 14X. The agitator shaft 14A is rotatable in accordance with rotation of a coupling 22 (described later). The flexible sheet 14B has a base end fixed to the agitator shaft 14A and a leading end configured to contact the inner surface of the casing 11. The agitator 14 is configured to agitate the toner T by making use of the rotating flexible sheet 14B.

As illustrated in FIG. 1, the transfer roller 4B faces the photosensitive drum 5B. The transfer roller 4B conveys the sheet S while nipping the sheet S between the transfer roller 4B and the photosensitive drum 5B.

The photosensitive drum 5B is charged by a charger (not illustrated) and is exposed to light by the exposure device, whereby an electrostatic latent image is formed on the photosensitive drum 5B. The developing cartridge 10 supplies the toner T to the electrostatic latent image to form a toner image on the photosensitive drum 5B. The toner image formed on the photosensitive drum 5B is transferred onto the sheet S supplied from the sheet supply portion 3 while the sheet S passes through between the photosensitive drum 5B and the transfer roller 4B.

The fixing device 4C thermally fixes the toner image transferred to the sheet S to the sheet S. The sheet S to which the toner image has been thermally fixed is discharged onto the sheet discharge tray 2B outside the main body housing 2.

The control device CU is a device which controls the entire operation of the laser printer 1.

The laser printer 1 includes a sensor 7. The sensor 7 is configured to detect whether or not the developing cartridge 10 is a new cartridge, and further detects the specification of the developing cartridge 10. The sensor 7 includes a lever 7A and an optical sensor 7B.

The lever 7A is swingably supported by the main body housing 2. The lever 7A is an example of a portion of the image forming apparatus. The lever 7A is positioned at a position where the lever 7A can contact protrusions rotatable together with a detection gear 200 (detection lever).

The optical sensor 7B is connected to the control device CU and outputs a detection signal to the control device CU. The control device CU is configured to identify the specification and the like of the developing cartridge 10 on the basis of the detection signal received from the optical sensor 7B. The optical sensor 7B detects displacement of the lever 7A and transmits the detection signal to the control device CU. More specifically, for example, a sensor unit including a light-emitting portion and a light-receiving portion is employed as the optical sensor 7B. The details will be described later.

Figure 3:
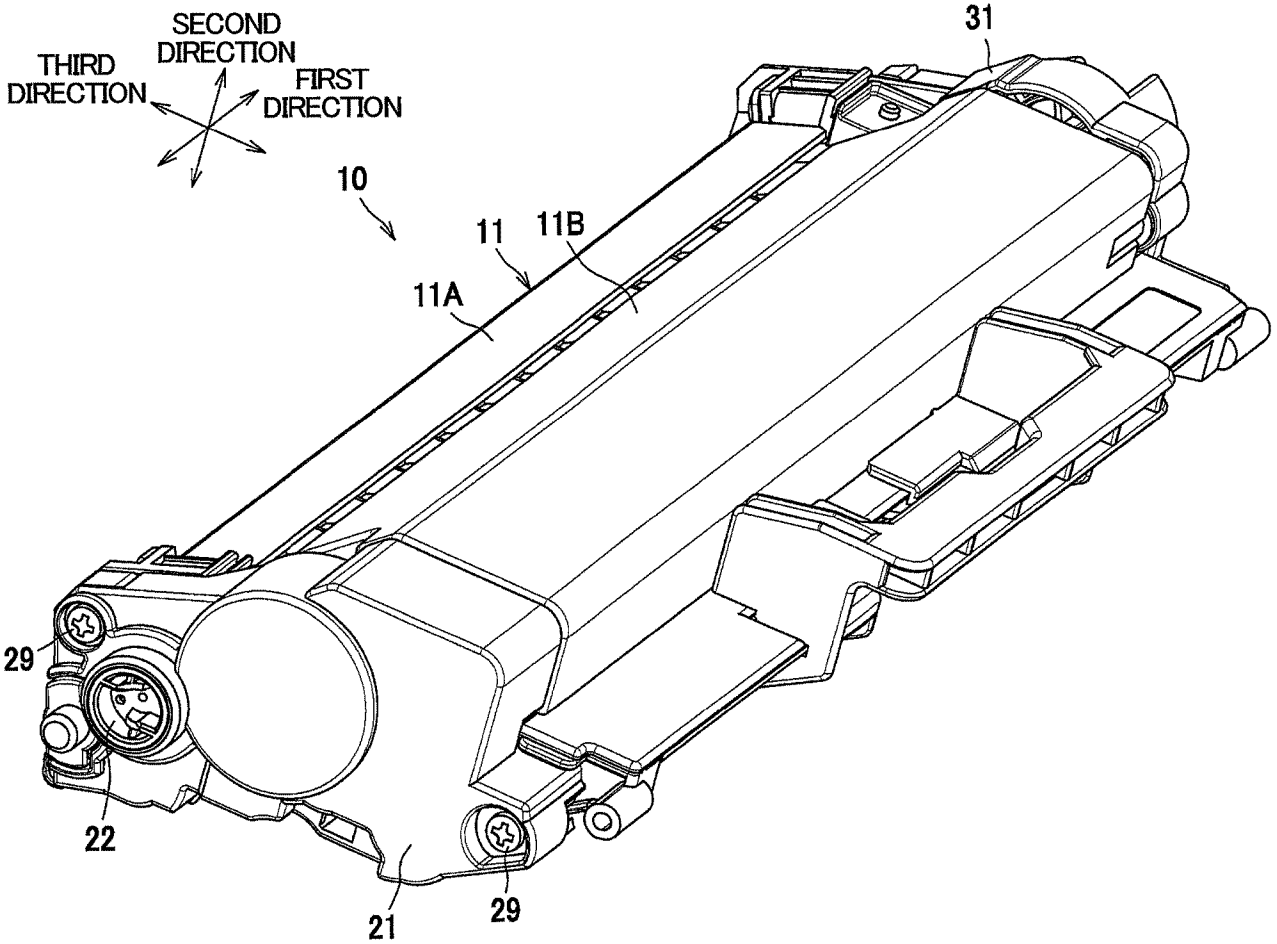
FIG. 3 is a perspective view illustrating one side in a first direction of the developing cartridge.
Figure 4:
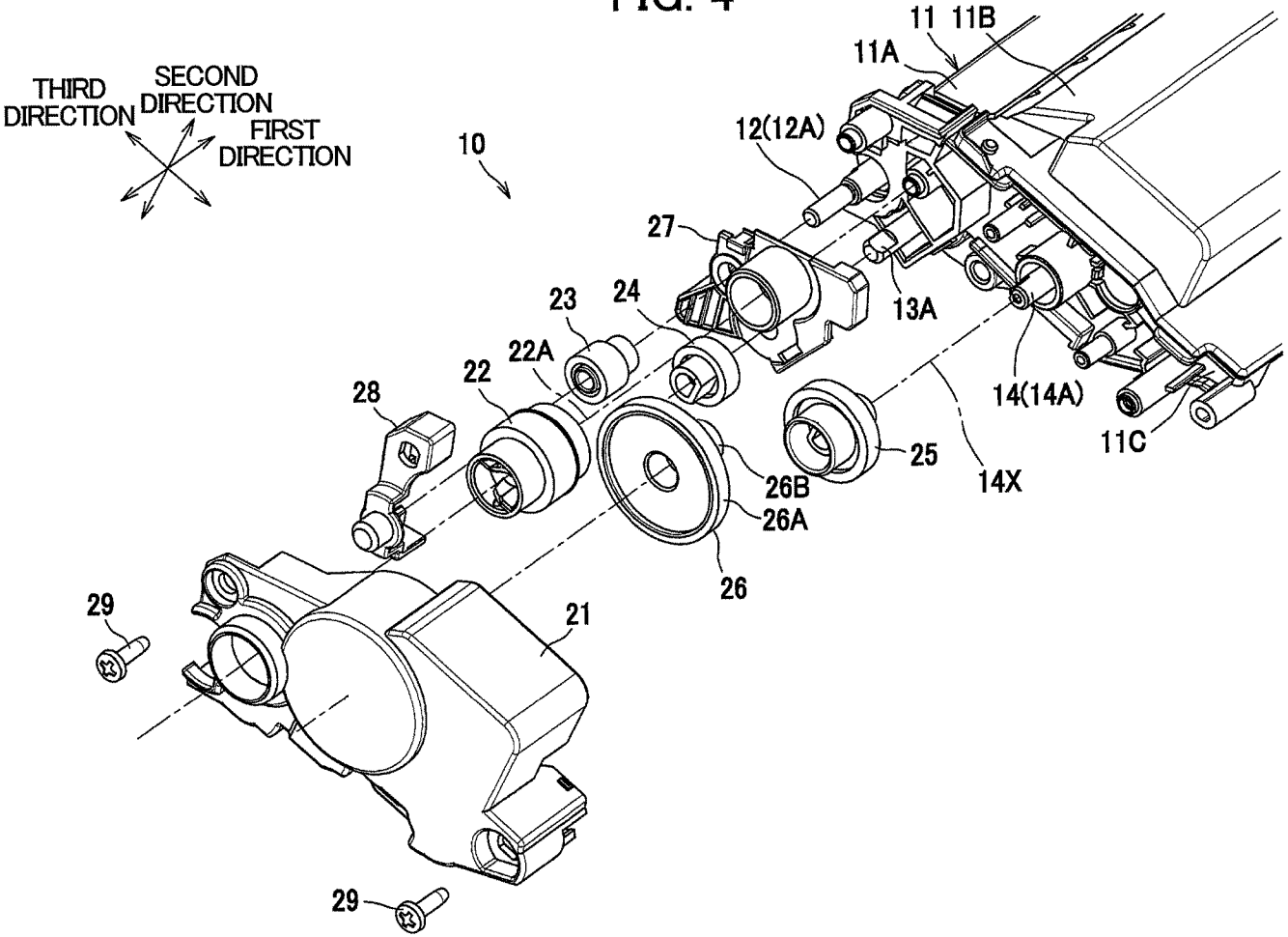
FIG. 4 is an exploded perspective view of parts positioned at one side in the first direction of a casing of the developing cartridge.

Next, the configuration of the developing cartridge 10 as an example of the developing cartridge according to the first embodiment will be described in detail. As illustrated in FIGS. 3 and 4, the developing cartridge 10 includes a first gear cover 21, the coupling 22, a developing gear 23, a supply gear 24, a first agitator gear 25, an idle gear 26, a first bearing member 27, and a cap 28. The first gear cover 21, the coupling 22, the developing gear 23, the supply gear 24, the first agitator gear 25, the idle gear 26, the first bearing member 27, and the cap 28 are positioned at one side of the casing 11 in the first direction.

The first gear cover 21 includes a shaft (not illustrated) and supports the idle gear 26 at the shaft. The first gear cover 21 covers at least one of the gears positioned at the one side of the casing 11 in the first direction. The first gear cover 21 is fixed to an outer surface 11C with screws 29. The outer surface 11C is an outer surface positioned at the one side of the casing 11 in the first direction.

Note that, in the present specification, "gear" is not limited to a member which has gear teeth and transmits a rotational force through the gear teeth, but includes a member which transmits a rotational force by a friction transmission. Further, with regard to the member which transmits the rotational force by the friction transmission, a circle along a friction transmitting surface (i.e., an outer circumferential surface which transmits the rotational force through friction) is defined as an addendum circle.

The coupling 22 is rotatable about a fourth axis 22A extending in the first direction. The coupling 22 is positioned at the one side of the casing 11 in the first direction. That is, the coupling 22 is positioned at the outer surface 11C. The coupling 22 is rotatable by receiving drive force. More specifically, the coupling 22 can receive drive force from the laser printer 1. The laser printer 1 includes a drive member (not illustrated), and the coupling 22 is rotatable by engaging with the drive member. The coupling 22 has a recessed portion which is recessed in the first direction. The recessed portion is configured to receive the drive member and to engage with the drive member. More specifically, engagement of the recessed portion with the drive member enables the recessed portion to receive drive force from the laser printer 1.

The developing gear 23 is mounted to the developing roller shaft 12A and is rotatable in accordance with rotation of the coupling 22. The developing gear 23 is positioned at the one side of the casing 11 in the first direction. That is, the developing gear 23 is positioned at the outer surface 11C.

The supply gear 24 is mounted to the supply roller shaft 13A and is rotatable in accordance with the rotation of the coupling 22. The supply gear 24 is positioned at the one side of the casing 11 in the first direction. That is, the supply gear 24 is positioned at the outer surface 11C.

The first agitator gear 25 is positioned at the one side of the casing 11 in the first direction. That is, the first agitator gear 25 is positioned at the outer surface 11C. The first agitator gear 25 is mounted to the agitator shaft 14A of the agitator 14. The first agitator gear 25 is rotatable together with the agitator 14 in accordance with the rotation of the coupling 22.

The idle gear 26 is positioned at the one side of the casing 11 in the first direction. That is, the idle gear 26 is positioned at the outer surface 11C. The idle gear 26 includes a large diameter portion 26A in engagement with the gear teeth of the coupling 22 and a small diameter portion 26B in engagement with the gear teeth of the first agitator gear 25. The idle gear 26 is rotatably supported by the shaft (not illustrated) of the first gear cover 21. The idle gear 26 decelerates rotation of the coupling 22 and transmits the decelerated rotation to the first agitator gear 25. Incidentally, the large diameter portion 26A is positioned farther from the casing 11 in the first direction than the small diameter portion 26B is from the casing 11.

The first bearing member 27 axially supports the coupling 22, the developing gear 23, and the supply gear 24. The first bearing member 27 is fixed to the one side of the casing 11 in the first direction.

The cap 28 covers one end portion of the developing roller shaft 12A in the first direction. The first gear cover 21 and the cap 28 may be made of mutually different resins.

Figure 5:
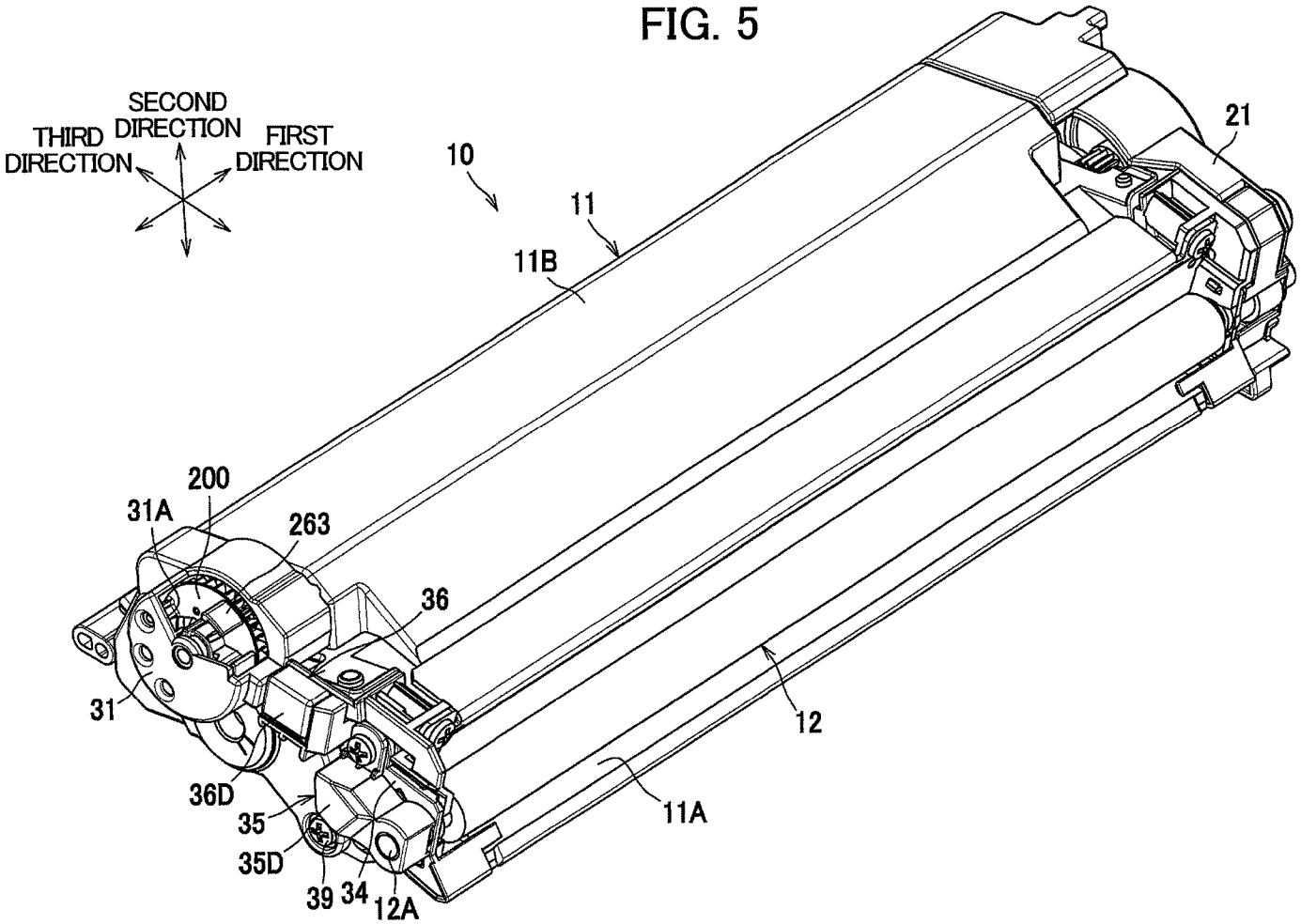
FIG. 5 is a perspective view illustrating another side in the first direction of the developing cartridge.
Figure 6:
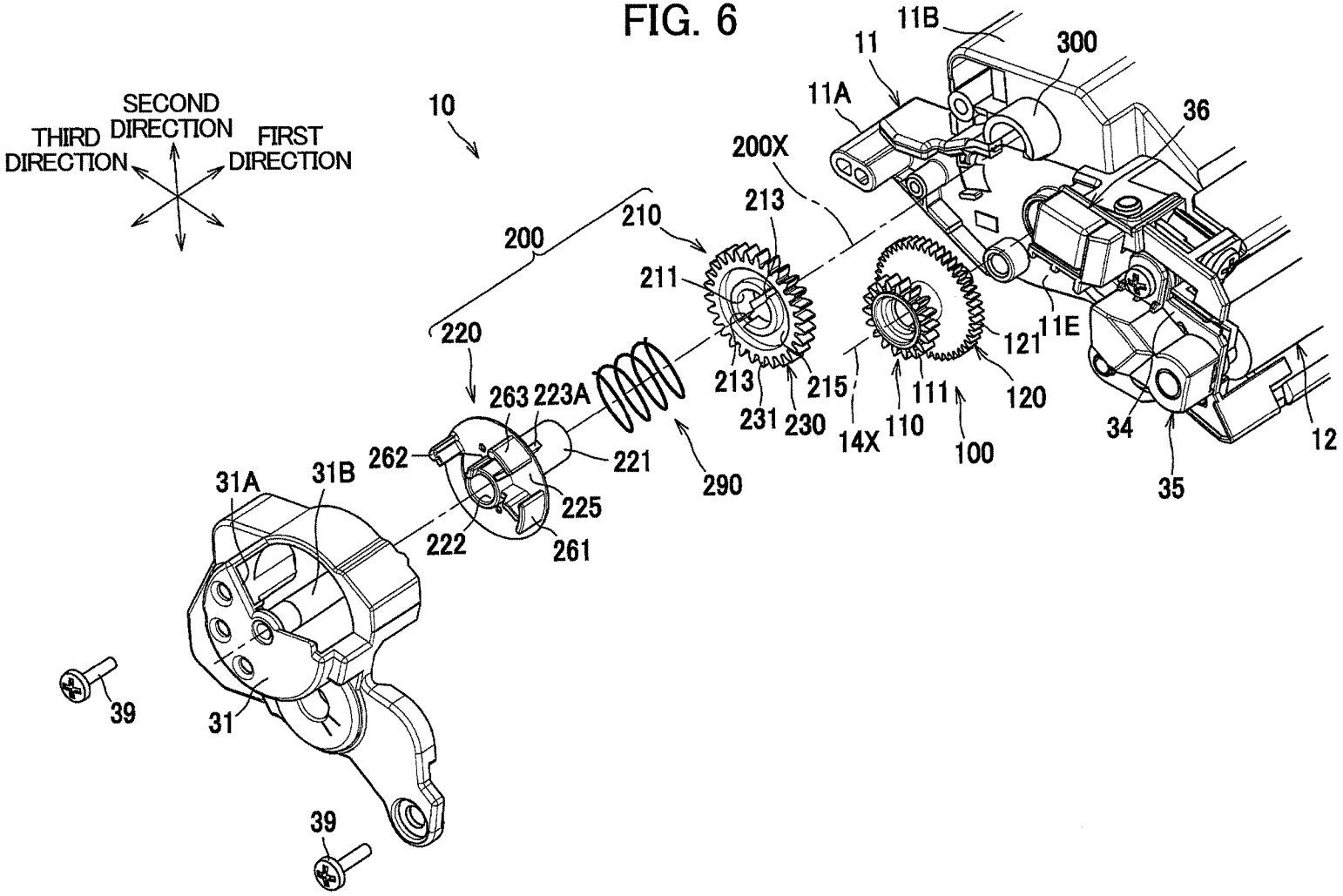
FIG. 6 is an exploded perspective view of parts of a gear structure positioned at another side in the first direction of the casing of the developing cartridge according to the first embodiment.

As illustrated in FIGS. 5 and 6, the developing cartridge 10 includes a second gear cover 31, the second agitator gear 100 as an example of a first gear, the detection gear 200 as an example of a second gear, a coil spring 290 as an example of an urging member, a second bearing member 34, a developing electrode 35, and a supply electrode 36. The second gear cover 31, the second agitator gear 100, the detection gear 200, the coil spring 290, the second bearing member 34, the developing electrode 35, and the supply electrode 36 are positioned at another side of the casing 11 in the first direction.

The second gear cover 31 covers at least a portion of the detection gear 200. The second gear cover 31 covers a portion of the detection gear 200, the second agitator gear 100. The second gear cover 31 is positioned at an outer surface 11E, which is positioned at another side of the container 11A of the casing 11 in the first direction. The second gear cover 31 has an opening 31A through which a portion of the detection gear 200 is exposed. The second gear cover 31 includes a shaft 31B extending in the first direction. The second gear cover 31 is fixed to the outer surface 11E with screws 39.

Figure 7:
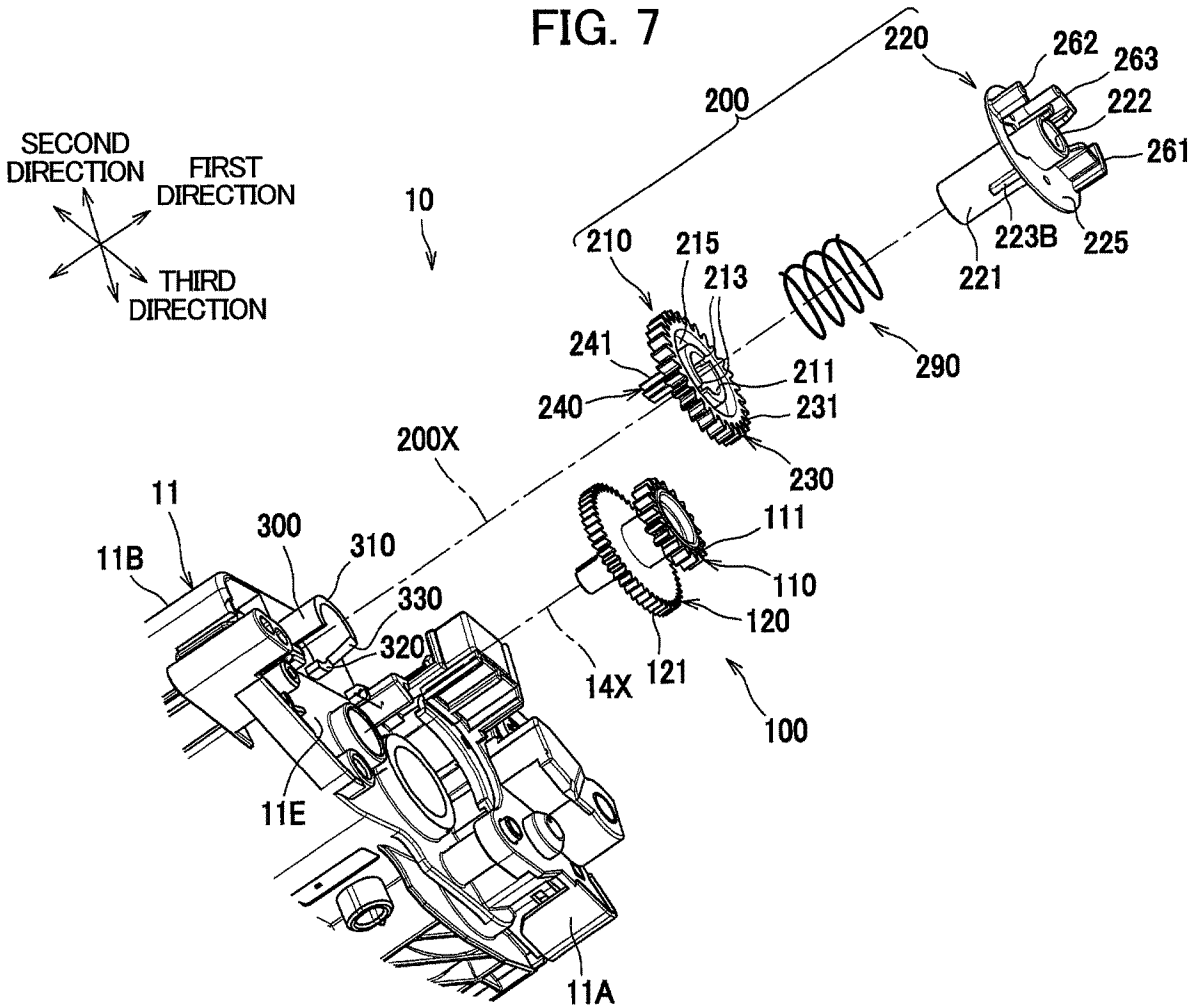
FIG. 7 is an exploded perspective view of the parts of the gear structure positioned at the other side in the first direction of the casing of the developing cartridge according to the first embodiment.

As illustrated in FIGS. 6 and 7, the second agitator gear 100 is positioned at the other side of the casing 11 in the first direction. That is, the second agitator gear 100 is positioned at the outer surface 11E which is positioned at the other side of the container 11A of the casing 11 in the first direction.

The second agitator gear 100 is in engagement with the agitator shaft 14A of the agitator 14. By this engagement, the second agitator gear 100 is mounted to the agitator shaft 14A. Thus, the second agitator gear 100 is rotatable about the first axis 14X together with the agitator shaft 14A. The second agitator gear 100 is rotatable together with the agitator 14. That is, the second agitator gear 100 is rotatably supported by the casing 11.

The second agitator gear 100 includes a first gear portion 110 and a second gear portion 120.

The first gear portion 110 includes a plurality of gear teeth 111. As an example, the first gear portion 110 is provided along the circumferential periphery of the second agitator gear 100. Preferably, the first gear portion 110 is provided along the entire circumferential periphery of the second agitator gear 100. In this case, the gear teeth 111 of the first gear portion 110 are provided over the entire circumferential periphery of the second agitator gear 100.

The second gear portion 120 is rotatable about the first axis 14X together with the first gear portion 110. The second gear portion 120 includes one gear tooth 121 or a plurality of gear teeth 121. In other words, the second gear portion 120 includes at least one gear tooth 121. As an example, the second gear portion 120 is provided along the circumferential periphery of the second agitator gear 100. Preferably, the second gear portion 120 is provided along the entire circumferential periphery of the second agitator gear 100. In this case, the gear teeth 121 of the second gear portion 120 are provided over the entire circumferential periphery of the second agitator gear 100.

The second gear portion 120 is positioned at a position different from a position of the first gear portion 110 in the axial direction. Specifically, the second gear portion 120 is positioned closer to the outer surface 11E of the casing 11 in the axial direction than the first gear portion 110 is to the outer surface 11E.

Further, the second gear portion 120 is positioned away from the first gear portion 110 in the axial direction. More specifically, the second gear portion 120 and the first gear portion 110 are positioned with a predetermined interval in the axial direction therebetween. As illustrated in FIG. 9B, an addendum circle 120A of the second gear portion 120 is greater in diameter than an addendum circle 110A of the first gear portion 110.

As illustrated in FIGS. 6 and 7, the detection gear 200 is positioned at the other side of the casing 11 in the first direction. That is, the detection gear 200 is positioned at the outer surface 11E. The detection gear 200 is rotatable about a second axis 200X extending in the axial direction. The detection gear 200 is engageable with the second agitator gear 100 and thus is rotatable in accordance with rotation of the second agitator gear 100.

The detection gear 200 includes a gear member 210 and a rotary member 220.

The gear member 210 includes a third gear portion 230 and a fourth gear portion 240. The third gear portion 230 and the fourth gear portion 240 are formed integrally with the gear member 210. That is, the gear member 210 includes the third gear portion 230 and the fourth gear portion 240.

The third gear portion 230 includes a plurality of gear teeth 231. As an example, the third gear portion 230 is provided along the circumferential periphery of the detection gear 200. Preferably, the third gear portion 230 is provided along the entire circumferential periphery of the detection gear 200. In this case, the gear teeth 231 of the third gear portion 230 are provided over the entire circumferential periphery of the detection gear 200. The gear teeth 231 of the third gear portion 230 are engageable with the gear teeth 111 of the first gear portion 110.

The fourth gear portion 240 is rotatable about the second axis 200X together with the third gear portion 230. The fourth gear portion 240 protrudes toward the outer surface 11E of the casing 11 in the first direction. The fourth gear portion 240 includes one gear tooth 241 or a plurality of gear teeth 241. In other words, the fourth gear portion 240 includes at least one gear tooth 241. As an example, the fourth gear portion 240 is provided along the circumferential periphery of the detection gear 200. Preferably, the fourth gear portion 240 is provided along a portion of the circumferential periphery of the detection gear 200. In this case, the gear teeth 241 of the fourth gear portion 240 are provided only at the portion of the circumferential periphery of the detection gear 200.

The length of the fourth gear portion 240 in the rotational direction of the detection gear 200 is smaller than the length of the third gear portion 230 in the rotational direction of the detection gear 200. The gear teeth 241 of the fourth gear portion 240 are engageable with the gear teeth 121 of the second gear portion 120. The fourth gear portion 240 is positioned at a position different from a position of the third gear portion 230 in the first direction. Specifically, the fourth gear portion 240 is positioned closer to the outer surface 11E in the first direction than the third gear portion 230 is to the outer surface 11E.

As illustrated in FIG. 9B, the addendum circle 240A of the fourth gear portion 240 is smaller than the addendum circle 230A of the third gear portion 230. As described above, the addendum circle 120A of the second gear portion 120 is greater than the addendum circle 110A of the first gear portion 110, and further the addendum circle 240A of the fourth gear portion 240 is smaller than the addendum circle 230A of the third gear portion 230. Accordingly, the detection gear 200 rotates at a low speed in a case where the first gear portion 110 and the third gear portion 230 are in engagement with each other, while the detection gear 200 rotates at a high speed in a case where the second gear portion 120 and the fourth gear portion 240 are in engagement with each other.

As illustrated in FIGS. 6 and 7, the rotary member 220 includes a tubular portion 221 extending in the axial direction. The tubular portion 221 has a hole 222 and two protruding portions, i.e., a protruding portion 223A and a protruding portion 223B. Further, the rotary member 220 includes a disk portion 225 extending in a direction crossing the axial direction. Preferably, the disk portion 225 extends in a direction orthogonal to the axial direction.

The shaft 31B of the second gear cover 31 is inserted into the hole 222 of the tubular portion 221. Thus, the rotary member 220 is supported by the shaft 31B so as to be rotatable relative to the shaft 31B. The leading end at one side in the first direction of the tubular portion 221 is inserted into the inside of a rib 300 (described later). Accordingly, the rotary member 220 is supported so as to be rotatable relative to the rib 300. That is, the detection gear 200 including the rotary member 220 is positioned between the casing 11 and the second gear cover 31 in the first direction, at least one end of the detection gear 200 in the first direction is supported so as to be rotatable relative to the casing 11, and at least another end of the detection gear 200 in the first direction is supported so as to be rotatable relative to the second gear cover 31. The leading end of the shaft 31B is inserted into a support hole (not illustrated) of the casing 11 inside the rib 300.

The protruding portions 223A and 223B are positioned at one side of the disk portion 225 in the first direction. The protruding portions 223A and 223B protrude outward from the tubular portion 221 in the radial direction of the detection gear 200. Further, the protruding portions 223A and 223B protrude in the axial direction from the disk portion 225. That is, the protruding portions 223A and 223B extend in the axial direction. The protruding portions 223A and 223B are disposed, with the tubular portion 221 interposed therebetween.

The gear member 210 has a hole 211 through which the tubular portion 221 of the rotary member 220 extends. Further, the gear member 210 has recessed portions 213 that are engageable with the protruding portions 223A and 223B of the rotary member 220 in the rotational direction of the detection gear 200. Since the tubular portion 221 is inserted into the hole 211 and the recessed portions 213 engage with the protruding portions 223A and 223B, the gear member 210 and the rotary member 220 can rotate together with each other. Further, the gear member 210 is movable relative to the rotary member 220 in the axial direction along the tubular portion 221. That is, the tubular portion 221 of the rotary member 220 serves as a guide portion for guiding the movement in the axial direction of the gear member 210. The gear member 210 has a disk portion 215 around the hole 211.

The rotary member 220 includes, a first protrusion 261, a second protrusion 262, and a third protrusion 263. Each of the first protrusion 261, the second protrusion 262, and the third protrusion 263 is positioned at another side of the disk portion 225 in the first direction. Further, each of the first protrusion 261, the second protrusion 262, and the third protrusion 263 can contact the lever 7A which is a portion of the laser printer 1, in a state where the developing cartridge 10 is attached to the laser printer 1.

The first protrusion 261 protrudes in the axial direction. Further, the first protrusion 261 protrudes in the radial direction of the detection gear 200. More specifically, the first protrusion 261 protrudes in the axial direction from the disk portion 225. Further, the first protrusion 261 protrudes outward in the radial direction of the detection gear 200 from the tubular portion 221. The first protrusion 261 is movable together with the detection gear 200. Preferably, the first protrusion 261 is rotatable together with the detection gear 200. The first protrusion 261 is formed integrally with the rotary member 220. That is, the rotary member 220 includes the first protrusion 261. Further, the detection gear 200 includes the first protrusion 261.

The second protrusion 262 protrudes in the axial direction. More specifically, the second protrusion 262 protrudes in the axial direction from the disk portion 225. The second protrusion 262 is positioned away from the first protrusion 261 in the rotational direction of the detection gear 200. The second protrusion 262 is movable together with the detection gear 200. Preferably, the second protrusion 262 is rotatable together with the detection gear 200. The second protrusion 262 is formed integrally with the rotary member 220. That is, the rotary member 220 includes the second protrusion 262. Further, the detection gear 200 includes the second protrusion 262.

The third protrusion 263 protrudes in the axial direction. Further, the third protrusion 263 protrudes in the radial direction of the detection gear 200. More specifically, the third protrusion 263 protrudes in the axial direction from the disk portion 225. Further, the third protrusion 263 protrudes outward in the radial direction of the detection gear 200 from the tubular portion 221. The third protrusion 263 is positioned away from the first protrusion 261 and the second protrusion 262 in the rotational direction of the detection gear 200. The third protrusion 263 is movable together with the detection gear 200. Preferably, the third protrusion 263 is rotatable together with the detection gear 200. The third protrusion 263 is formed integrally with the rotary member 220. That is, the rotary member 220 includes the third protrusion 263. Further, the detection gear 200 includes the third protrusion 263.

The first protrusion 261 is positioned at a position in the radial direction of the detection gear 200 where the first protrusion 261 can contact the lever 7A. The second protrusion 262 is positioned at a position in the radial direction of the detection gear 200 where the second protrusion 262 can contact the lever 7A. The third protrusion 263 is positioned at a position in the radial direction of the detection gear 200 where the third protrusion 263 can contact the lever 7A. The third protrusion 263, the second protrusion 262, and the first protrusion 261 are arranged in this order in a direction opposite to the rotational direction of the detection gear 200. The leading ends in the axial direction of the first protrusion 261, the second protrusion 262, and the third protrusion 263 each have a predetermined length in the rotational direction. The leading end in the axial direction of the second protrusion 262 is shorter in length in the rotational direction of the detection gear 200 than the leading ends of the first protrusion 261 and the third protrusion 263.

The coil spring 290 urges the third gear portion and the fourth gear portion 240 toward a second position (described later). More specifically, the coil spring 290 urges the gear member 210 toward the second position. The coil spring 290 is positioned between the disk portion 215 of the gear member 210 and the disk portion 225 of the rotary member 220 in the axial direction.

The casing 11 includes the rib 300. The rib 300 protrudes in the axial direction toward the third gear portion 230. More specifically, the rib 300 protrudes from the outer surface 11E of the casing 11 toward the gear member 210. As illustrated in FIG. 9B, the rib 300 extends along a portion of the addendum circle 240A of the fourth gear portion 240. The rib 300 has a C-shaped cross section. The rib 300 has a first surface 310, a second surface 320, and a third surface 330. That is, the casing 11 has the first surface 310, the second surface 320, and the third surface 330. Each of the first surface 310, the second surface 320, and the third surface 330 is an end face of the rib 300 in the axial direction.

The second surface 320 is positioned at a position different from a position of the first surface 310 in the axial direction. Further, the second surface 320 is positioned away from the first surface 310 in the rotational direction of the detection gear 200. More specifically, the second surface 320 is positioned closer to the outer surface 11E of the casing 11 in the axial direction than the first surface 310 is to the outer surface 11E. Further, the second surface 320 is positioned away from and downstream of the first surface 310 in the rotational direction of the detection gear 200. The length of the first surface 310 in the rotational direction of the detection gear 200 is longer than the length of the second surface 320 in the rotational direction of the detection gear 200.

The third surface 330 connects the first surface 310 and the second surface 320. The third surface 330 is positioned between the first surface 310 and the second surface 320 in the rotational direction of the detection gear 200. The third surface 330 is inclined so as to approach the outer surface 11E of the casing 11 toward the second surface 320 from the first surface 310.

Figure 9A:
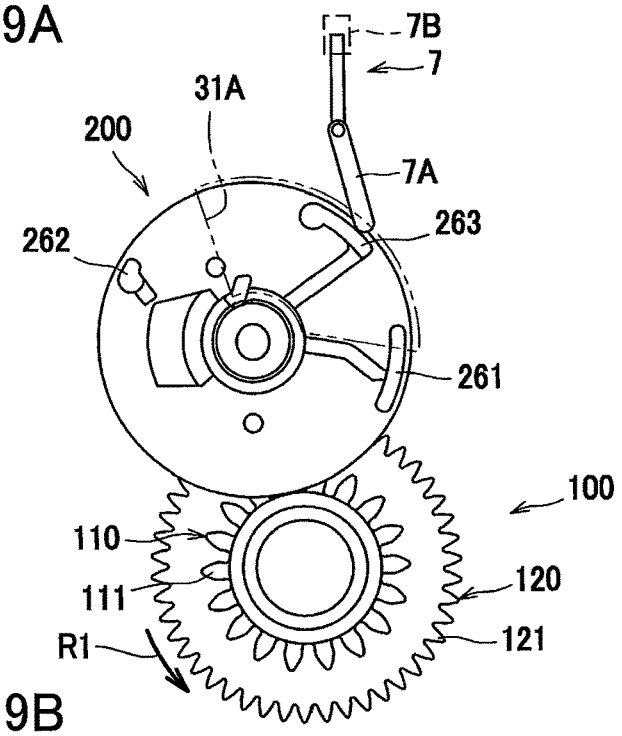
FIG. 9A is a view illustrating a detection gear and a second agitator gear as viewed from the outside of the developing cartridge, the view illustrating a state where the detection gear is positioned at an initial position.
Figure 9B:
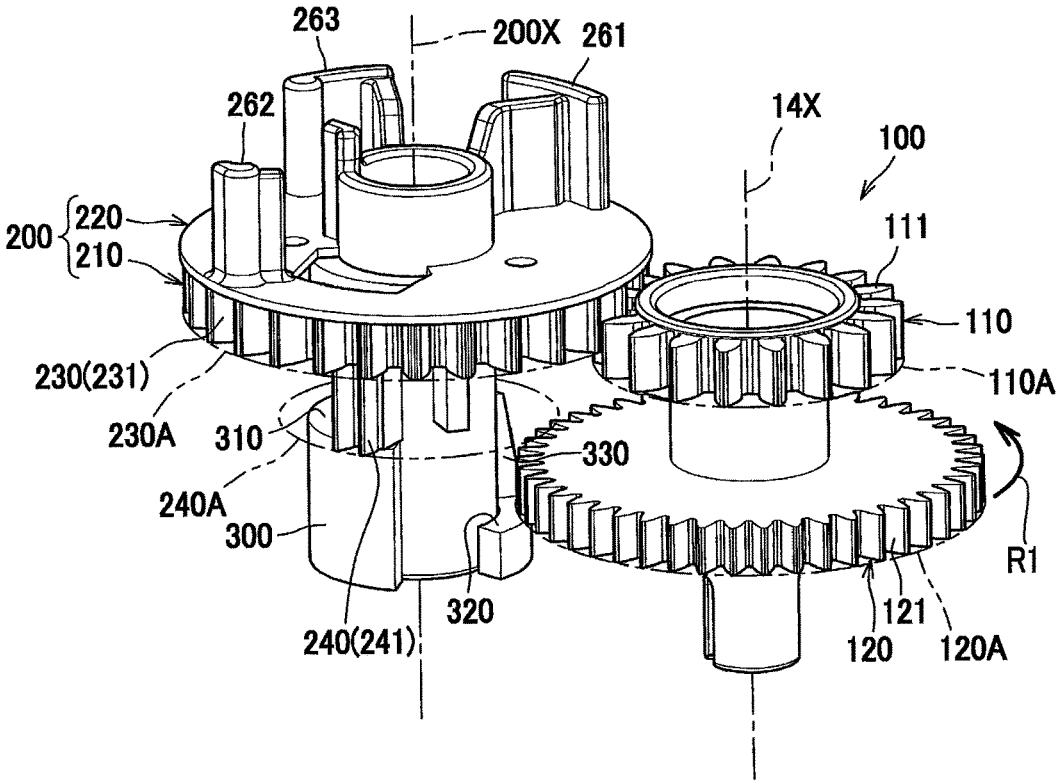
FIG. 9B is a perspective view illustrating the detection gear and the second agitator gear in a state where the detection gear is positioned at the initial position.

In a case where the detection gear 200 is in an unused state, the detection gear 200 is positioned at the position illustrated in FIGS. 9A and 9B. Hereinafter, the positions of the second agitator gear 100 and the detection gear 200 illustrated in FIGS. 9A and 9B are each referred to as "initial position." The initial position of the detection gear 200 is an example of a first rotational position. Incidentally, in a case where the detection gear 200 is positioned at the initial position, the developing cartridge 10 is in an unused state.

As illustrated in FIG. 9A, in a state where the detection gear 200 is positioned at the initial position, the leading end of the third protrusion 263 is exposed through the opening 31A of the second gear cover 31. Further, in the state where the detection gear 200 is positioned at the initial position, the leading end of the third protrusion 263 is in contact with the lever 7A. As a result, the lever 7A is positioned between the light-emitting portion and the light-receiving portion of the optical sensor 7B, thereby causing light emitted from the light-emitting portion to be shielded by the lever 7A.

Figure 11A:
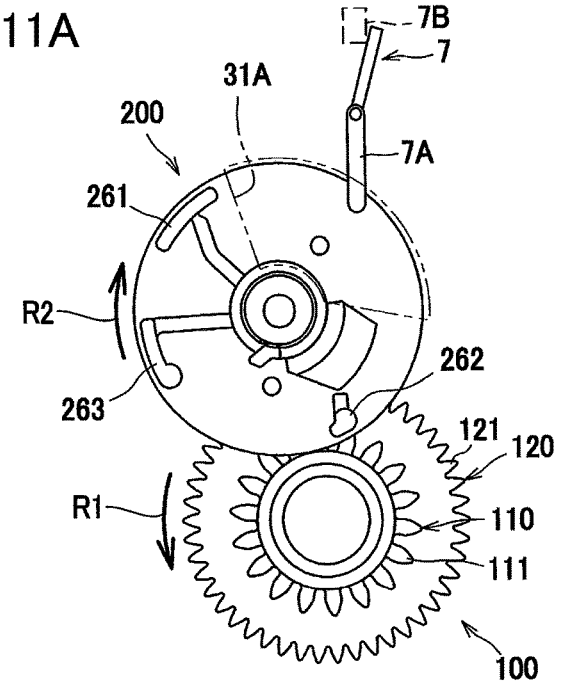
FIG. 11A is a view illustrating the detection gear and the second agitator gear as viewed from the outside of the developing cartridge, the view illustrating a state where the detection gear is positioned at the third rotational position.
Figure 11B:
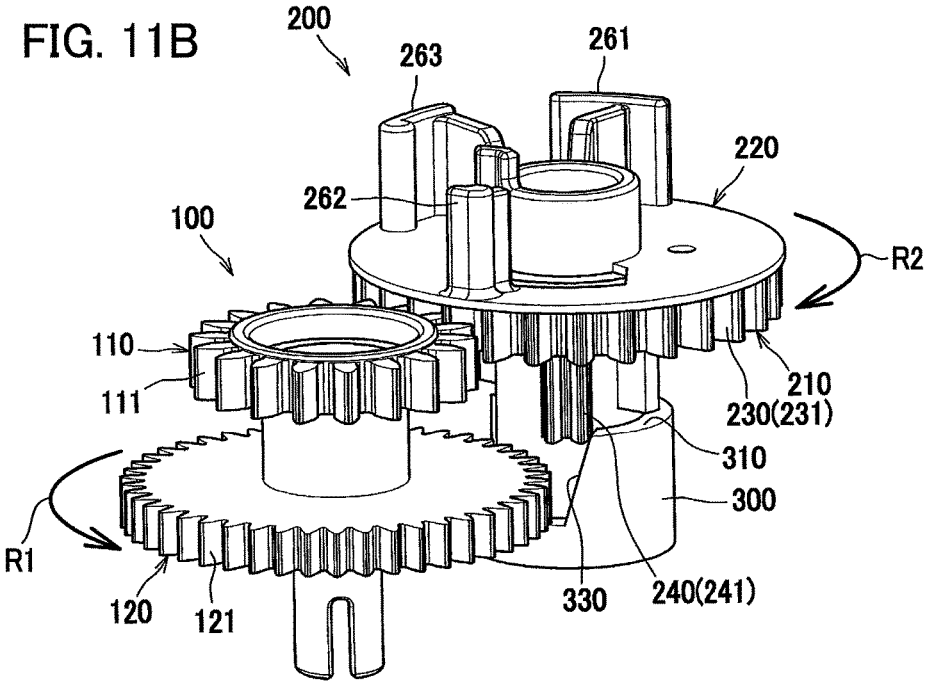
FIG. 11B is a perspective view illustrating the detection gear and the second agitator gear in a state where the detection gear is positioned at the third rotational position.

The detection gear 200 is rotatable about the second axis 200X from the initial position to a third rotational position illustrated in FIGS. 11A and 11B. The third rotational position is a position where contact between the leading end of the fourth gear portion 240 and the first surface 310 of the rib 300 is released.

Figure 12A:
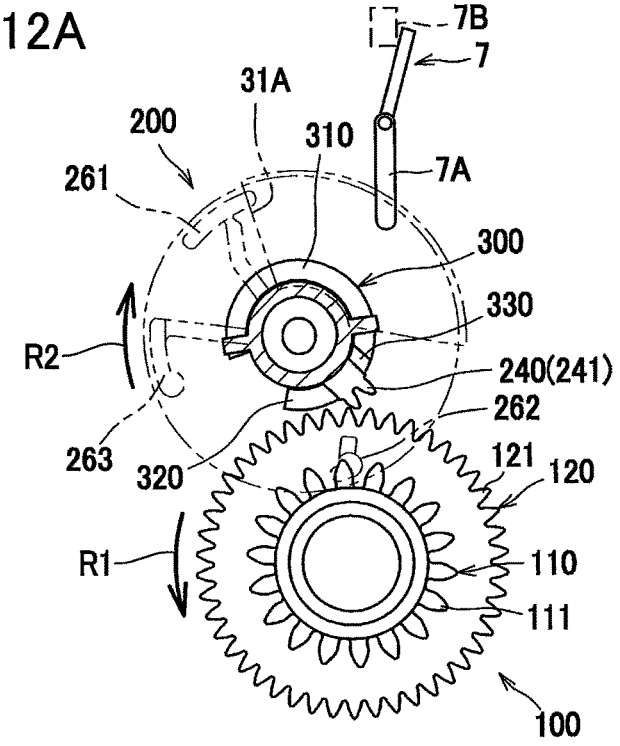
FIG. 12A is a view illustrating the detection gear and the second agitator gear as viewed from the outside of the developing cartridge, the view illustrating a state where the detection gear is positioned at a fourth rotational position.
Figure 12B:
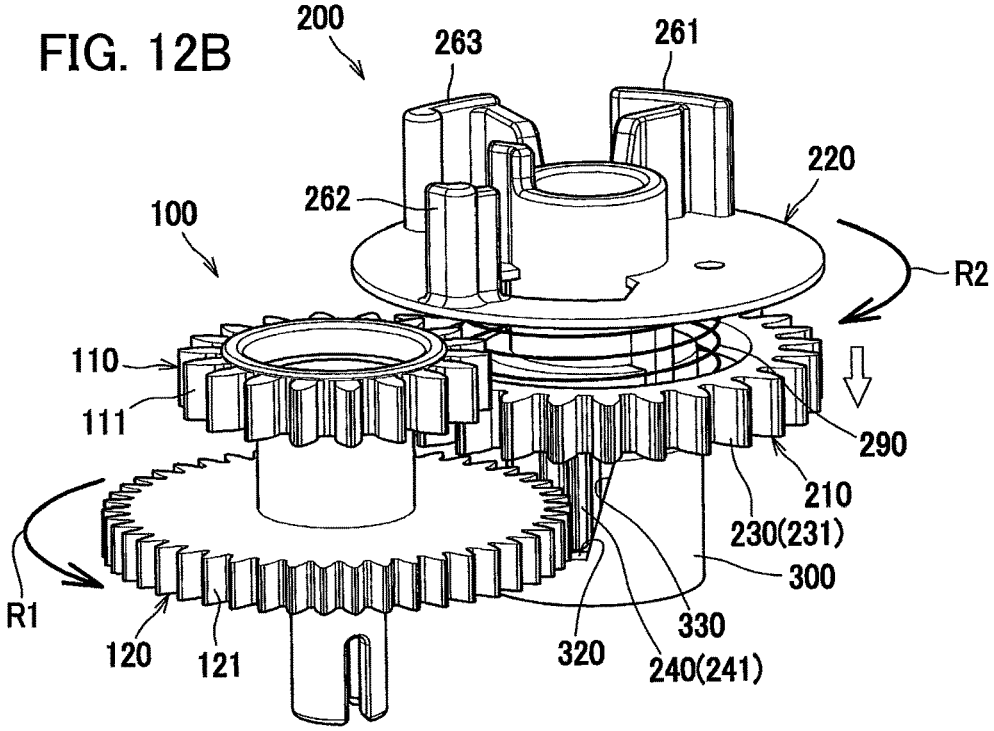
FIG. 12B is a perspective view illustrating the detection gear and the second agitator gear in a state where the detection gear is positioned at the fourth rotational position.

Further, the detection gear 200 is rotatable from the third rotational position to a fourth rotational position illustrated in FIGS. 12A and 12B. The fourth rotational position is a position where contact between the leading end of the fourth gear portion 240 and the third surface 330 of the rib 300 is released.

Figure 13A:
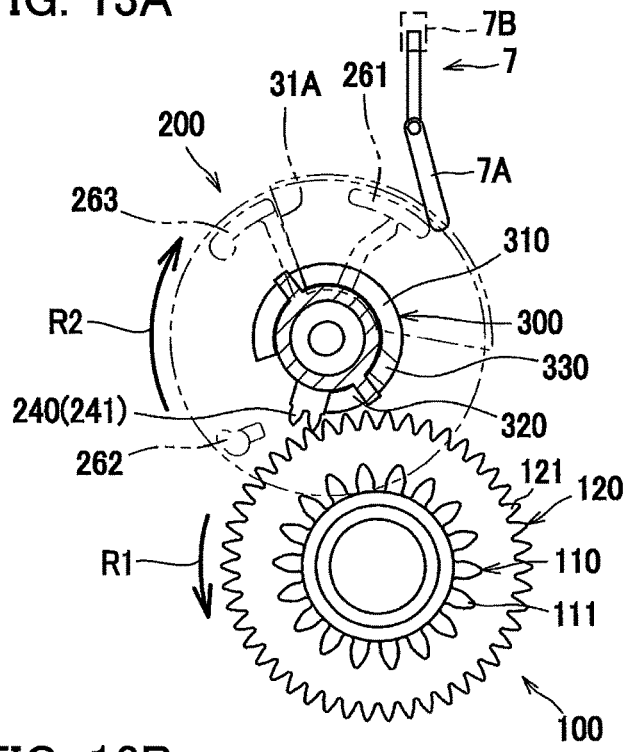
FIG. 13A is a view illustrating the detection gear and the second agitator gear as viewed from the outside of the developing cartridge, the view illustrating a process of rotation of the detection gear from the fourth rotational position to a final position.
Figure 13B:
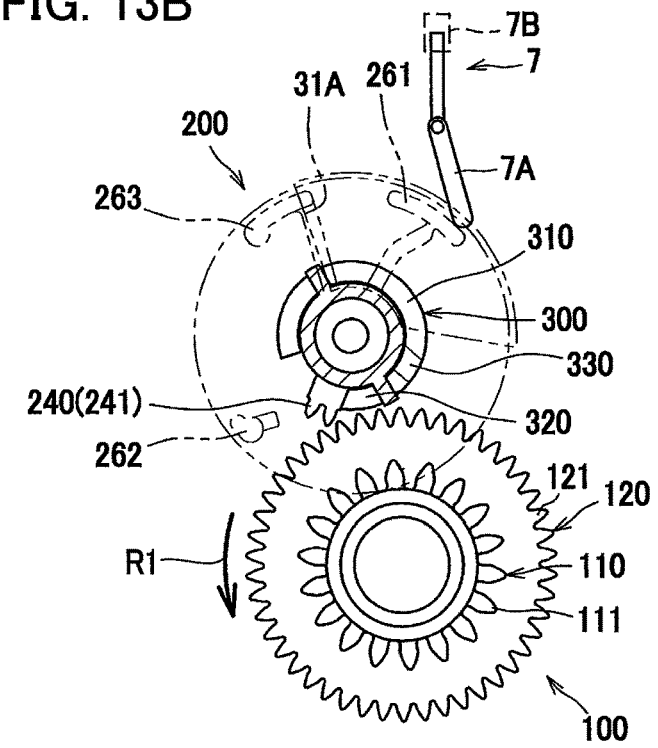
FIG. 13B is a view illustrating the detection gear and the second agitator gear as viewed from the outside of the developing cartridge, the view illustrating the process of rotation of the detection gear from the fourth rotational position to the final position.

Further, the detection gear 200 is rotatable from the fourth rotational position to a final position illustrated in FIG. 13B. The final position is an example of a second rotational position.

The detection gear 200 rotates from the initial position illustrated in FIG. 9A to the final position illustrated in FIG. 13B through the third rotational position illustrated in FIG. 11A and the fourth rotational position illustrated in FIG. 12A, and then stops. That is, the detection gear 200 is rotatable from the initial position to the final position.

The third gear portion 230 and the fourth gear portion 240 are configured to move relative to the casing 11 from a first position to a second position during rotation of the detection gear 200 from the initial position to the final position. More specifically, the gear member 210 is configured to move relative to the rotary member 220 in the axial direction from the first position illustrated in FIG. 9B to the second position illustrated in FIG. 12B, together with the third gear portion 230 and the fourth gear portion 240.

As illustrated in FIG. 9B, when the gear member 210 including the third gear portion 230 and the fourth gear portion 240 is positioned at the first position, the leading end of the fourth gear portion 240 in the axial direction is in contact with the first surface 310 of the rib 300. When the gear member 210 is positioned at the first position, the first gear portion 110 and the third gear portion 230 can engage with each other, whereas the second gear portion 120 and the fourth gear portion 240 do not engage with each other. More specifically, when the gear member 210 is positioned at the first position, the gear teeth 111 of the first gear portion 110 and the gear teeth 231 of the third gear portion 230 are in engagement with each other, whereas the gear teeth 121 of the second gear portion 120 and the gear teeth 241 of the fourth gear portion 240 do not engage with each other. During rotation of the detection gear 200 from the initial position to the third rotational position, the gear member 210 is positioned at the first position.

As illustrated in FIG. 12B, the second position is a position different from the first position in the axial direction. Specifically, when the gear member 210 is positioned at the second position, the gear member 210 is positioned closer to the outer surface 11E of the casing 11 than when the gear member 210 is positioned at the first position. In other words, the gear member 210 at the second position is closer to the outer surface 11E in the axial direction (i.e., the first direction) than the gear member 210 at the first position is to the outer surface 11E. Further, stated differently, when the third gear portion 230 is positioned at the second position, the third gear portion 230 is closer to the outer surface 11E of the casing 11 than when the third gear portion 230 is positioned at the first position; and when the fourth gear portion 240 is positioned at the second position, the fourth gear portion 240 is closer to the outer surface 11E of the casing 11 than when the fourth gear portion 240 is positioned at the first position. When the gear member 210 is positioned at the second position, the leading end of the fourth gear portion 240 is in contact with the second surface 320 of the rib 300.

When the gear member 210 is positioned at the second position, the second gear portion 120 and the fourth gear portion 240 can engage with each other, whereas the first gear portion 110 and the third gear portion 230 do not engage with each other. More specifically, when the gear member 210 is positioned at the second position, the third gear portion 230 is positioned between the first gear portion 110 and the second gear portion 120 in the axial direction, and the gear teeth 111 of the first gear portion 110 and the gear teeth 231 of the third gear portion 230 do not engage with each other.

Further, when the gear member 210 is positioned at the second position, the detection gear 200 can rotate from an engagement position where the gear teeth 121 of the second gear portion 120 and the gear teeth 241 of the fourth gear portion 240 are in engagement with each other to a non-engagement position where the gear teeth 121 of the second gear portion 120 and the gear teeth 241 of the fourth gear portion 240 do not engage with each other. That is, when the gear member 210 is positioned at the second position, the second gear portion 120 and the fourth gear portion 240 need not always be in engagement with each other. The engagement position is, for example, the position illustrated in FIG. 13A. The non-engagement position is the final position illustrated in FIG. 13B. During rotation of the detection gear 200 from the fourth rotational position to the final position, the gear member 210 is positioned at the second position.

When the contact between the leading end of the fourth gear portion 240 and the first surface 310 of the rib 300 is released by the rotation of the detection gear 200, the gear member 210 can move from the first position to the second position by the urging force of the coil spring 290 (see FIG. 12B) positioned between the gear member 210 and the rotary member 220. During the movement of the gear member 210 from the first position to the second position, the leading end of the fourth gear portion 240 shifts from a state of contacting the first surface 310 to a state of contacting the third surface 330, and further from the state of contacting the third surface 330 to a state of contacting the second surface 320. During the rotation of the detection gear 200 from the third rotational position to the fourth rotational position, the gear member 210 moves moved from the first position to the second position.

Figure 10A:
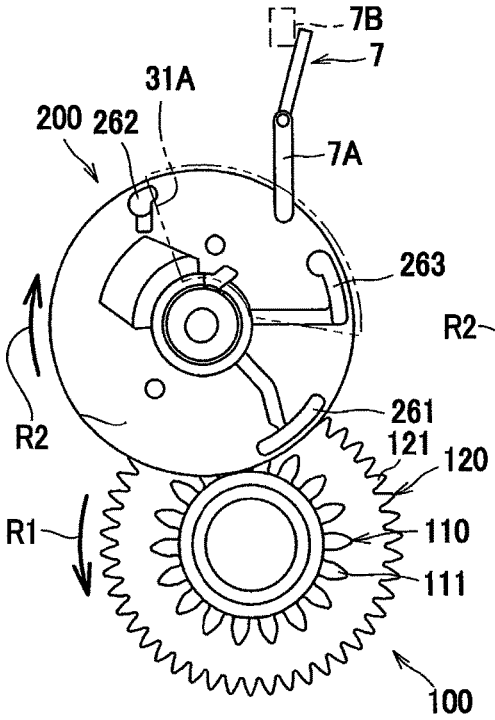
FIG. 10A is a view illustrating the detection gear and the second agitator gear as viewed from the outside of the developing cartridge, the view illustrating a process of rotation of the detection gear from the initial position to a third rotational position.
Figure 10B:
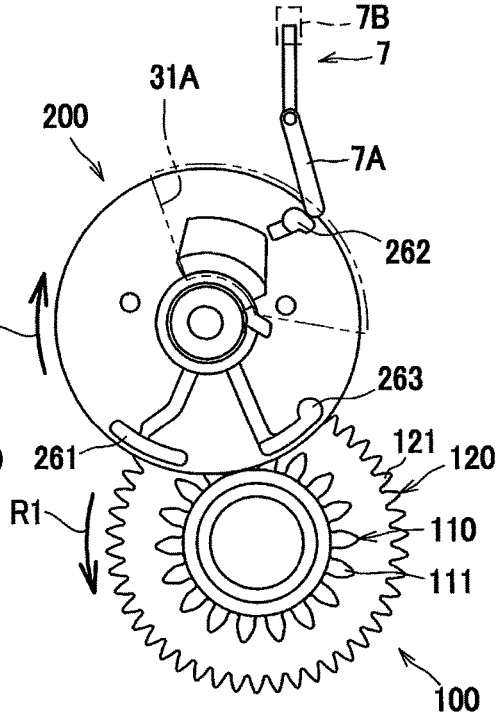
FIG. 10B is a view illustrating the detection gear and the second agitator gear as viewed from the outside of the developing cartridge, the view illustrating the process of rotation of the detection gear from the initial position to the third rotational position.

When the detection gear 200 is positioned at the position illustrated in FIG. 10A, the leading end of the second protrusion 262 does not contact the lever 7A; while when the detection gear 200 is positioned at the position illustrated in FIG. 10B, the leading end of the second protrusion 262 contacts the lever 7A to thereby cause the lever 7A to be positioned between the light-emitting portion and the light-receiving portion of the optical sensor 7B. As a result, light emitted from the light-emitting portion is shielded by the lever 7A. When the detection gear 200 is positioned at the position illustrated in FIG. 10C, the leading end of the second protrusion 262 does not contact the lever 7A.

In a state where the detection gear 200 is positioned at the final position illustrated in FIG. 13B, the first protrusion 261 is positioned at substantially the same position as the third protrusion 263 in a state where the detection gear 200 is positioned at the initial position. When the detection gear 200 is positioned at the final position, the leading end of the first protrusion 261 contacts the lever 7A to thereby cause the lever 7A to be positioned between the light-emitting portion and the light-receiving portion of the optical sensor 7B. As a result, light emitted from the light-emitting portion is shielded by the lever 7A.

Figure 10C:
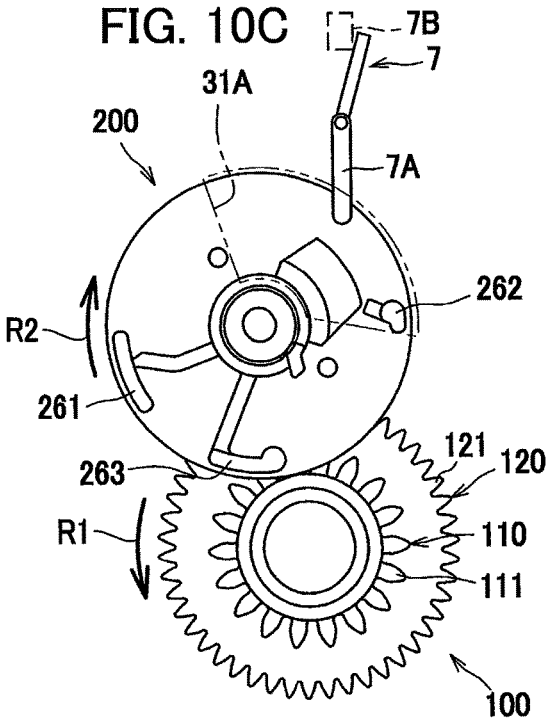
FIG. 10C is a view illustrating the detection gear and the second agitator gear as viewed from the outside of the developing cartridge, the view illustrating the process of rotation of the detection gear from the initial position to the third rotational position.

Not only when the detection gear 200 is in the state illustrated in, for example, FIG. 10A but also when the detection gear 200 is in the state illustrated in, for example, FIG. 10C, none of the leading ends of the first protrusion 261, the second protrusion 262, and the third protrusion 263 contact the lever 7A, and thus the lever 7A is not positioned between the light-emitting portion and the light-receiving portion of the optical sensor 7B. As a result, light emitted from the light-emitting portion is not shielded by the lever 7A, thereby allowing the light-receiving portion to receive the light emitted from the light-emitting portion.

The laser printer 1 can identify the specification of the developing cartridge 10 by making use of a detection signal obtained on the basis of changes between a state where the light-receiving portion receives light and a state where the light-receiving portion does not receive light.

Further, in the present embodiment, the leading end of the third protrusion 263 is in contact with the lever 7A when the detection gear 200 is positioned at the initial position, and the leading end of the first protrusion 261 is in contact with the lever 7A even when the detection gear 200 is positioned at the final position. Thus, the laser printer 1 can determine, by virtue of using the first protrusion 261 and the third protrusion 263, whether or not the developing cartridge 10 is attached to the laser printer 1.

Figure 8:
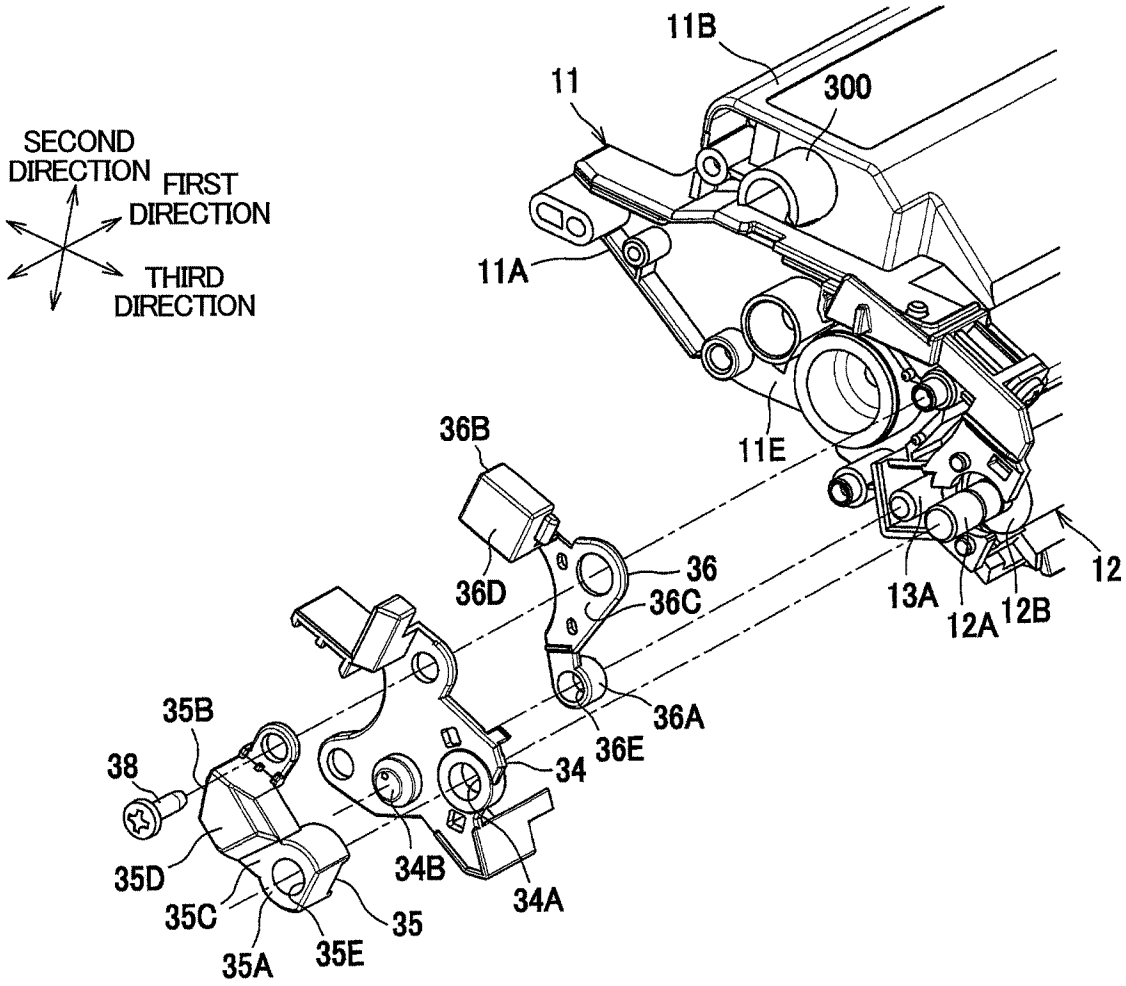
FIG. 8 is an exploded perspective view of parts of electrodes positioned at the other side in the first direction of the casing of the developing cartridge.

As illustrated in FIG. 8, the second bearing member 34 includes a first support portion 34A and a second support portion 34B. The first support portion 34A rotatably supports the developing roller shaft 12A. The second support portion 34B rotatably supports the supply roller shaft 13A. In a state where the second bearing member 34 supports the developing roller shaft 12A and the supply roller shaft 13A, the second bearing member 34 is fixed to the outer surface 11E positioned at the other side of the container 11A of the casing 11 in the first direction.

The developing electrode 35 is positioned at the other side of the casing 11 in the first direction. That is, the developing electrode 35 is positioned at the outer surface 11E. The developing electrode 35 is configured to supply electric power to the developing roller shaft 12A. For example, the developing electrode 35 is made of electrically conductive resin.

The developing electrode 35 includes a first electrical contact 35A, a second electrical contact 35B, and a connection portion 35C. The first electrical contact 35A is in contact with the developing roller shaft 12A. The connection portion 35C couples the first electrical contact 35A and the second electrical contact 35B to thereby electrically connect the first electrical contact 35A and the second electrical contact 35B.

The first electrical contact 35A has a contact hole 35E. The developing roller shaft 12A is inserted into the contact hole 35E. Preferably, the contact hole 35E is a circular hole. In a state where the developing roller shaft 12A is inserted into the contact hole 35E, the first electrical contact 35A is in contact with a portion of the developing roller shaft 12A. Specifically, in the state where the developing roller shaft 12A is inserted into the contact hole 35E, the first electrical contact 35A is in contact with the outer circumferential surface of the developing roller shaft 12A.

The second electrical contact 35B of the developing electrode 35 includes a developing contact surface 35D extending in the second direction and the third direction.

The supply electrode 36 is positioned at the other side of the casing 11 in the first direction. That is, the supply electrode 36 is positioned at the outer surface 11E. The supply electrode 36 is configured to supply electric power to the supply roller shaft 13A. For example, the supply electrode 36 is made of electrically conductive resin.

The supply electrode 36 includes a first electrical contact 36A, a second electrical contact 36B, and a connection portion 36C. The first electrical contact 36A is in contact with the supply roller shaft 13A. The connection portion 36C couples the first electrical contact 36A and the second electrical contact 36B to thereby electrically connect the first electrical contact 36A and the second electrical contact 36B.

The first electrical contact 36A has a contact hole 36E. The supply roller shaft 13A is inserted into the contact hole 36E. Preferably, the contact hole 36E is a circular hole. In a state where the supply roller shaft 13A is inserted into the contact hole 36E, the first electrical contact 36A is in contact with a portion of the supply roller shaft 13A. Specifically, in the state where the supply roller shaft 13A is inserted into the contact hole 36E, the first electrical contact 36A is in contact with the outer circumferential surface of the supply roller shaft 13A. The second electrical contact 36B of the supply electrode 36 includes a supply contact surface 36D extending in the second direction and the third direction.

The developing electrode 35 and the supply electrode 36 are fixed, together with the second bearing member 34, to the outer surface 11E positioned at the other side of the casing 11 in the first direction with a screw 38.

Functions and effects of the developing cartridge 10 configured as described above will be described. For attaching the developing cartridge 10 to the laser printer 1, the developing cartridge 10 moves toward the inside of the main body housing 2 in the third direction with the developing roller 12 in the lead, as illustrated in FIG. 1.

When the developing cartridge 10 is in the unused state as illustrated in FIG. 1, that is, in a state where the detection gear 200 is positioned at the initial position, the leading end of the third protrusion 263 is exposed through the opening 31A of the second gear cover 31. Thus, the leading end of the third protrusion 263 contacts the lever 7A to swingably move the lever 7A. As described above, when the optical sensor 7B detects the displacement of the lever 7A, the controller CU can determine that the developing cartridge 10 is attached to the laser printer 1. Although a portion of the first protrusion 261 may be exposed through the opening 31A when the detection gear 200 is positioned at the initial position, the first protrusion 261 does not contact the lever 7A since the first protrusion 261 is separated away from the third protrusion 263.

When the laser printer 1 starts to be driven according to an instruction from the control device CU, the coupling 22 illustrated in FIG. 4 rotates to rotate the first agitator gear 25 through the idle gear 26. By this rotation of the first agitator gear 25, the second agitator gear 100 positioned at the other side of the casing 11 in the first direction rotates in an arrow direction R1 (see FIGS. 9A and 9B) via the agitator shaft 14A.

As illustrated in FIGS. 9A and 9B, when the second agitator gear 100 rotates in the arrow direction R1, the rotational force of the second agitator gear 100 is transmitted to the detection gear 200 due to engagement between the first gear portion 110 and the third gear portion 230, thereby causing the detection gear 200 to rotate in an arrow direction R2 (see FIG. 10A) at a low speed in accordance with the rotation of the second agitator gear 100.

When the detection gear 200 rotates in the arrow direction R2, the lever 7A is positioned between the third protrusion 263 and the second protrusion 262, as illustrated in FIG. 10A. That is, none of the first protrusion 261, the second protrusion 262, and the third protrusion 263 are in contact with the lever 7A. As a result, the lever 7A is not positioned between the light-emitting portion and the light-receiving portion of the optical sensor 7B, and therefore the signal received by the optical sensor 7B is changed.

When the detection gear 200 further rotates, the second protrusion 262 is exposed through the opening 31A and contacts the lever 7A at a low speed, as illustrated in FIG. 10B. As a result, the lever 7A is positioned between the light-emitting portion and the light-receiving portion of the optical sensor 7B, and the signal received by the optical sensor 7B is changed. In the present embodiment, the second protrusion 262 contacts the lever 7A while the first gear portion 110 and the third gear portion 230 are in engagement with each other.

When the detection gear 200 further rotates, the lever 7A is positioned between the second protrusion 262 and the first protrusion 261, as illustrated in FIG. 10C. That is, none of the first protrusion 261, the second protrusion 262, and the third protrusion 263 are in contact with the lever 7A. Thus, the lever 7A is not positioned between the light-emitting portion and the light-receiving portion of the optical sensor 7B, and therefore the signal received by the optical sensor 7B is changed.

When the detection gear 200 further rotates to reach the third rotational position as illustrated in FIGS. 11A and 11B, contact between the leading end of the fourth gear portion 240 and the first surface 310 of the rib 300 is released.

Then, when the detection gear 200 further rotates, the gear member 210 moves in the axial direction from the first position to the second position by the urging force of the coil spring 290 while the leading end of the fourth gear portion 240 is in contact with the inclined third surface 330 of the rib 300.

By the movement of the gear member 210 from the first position to the second position, the gear teeth 231 of the third gear portion 230 of the detection gear 200 is separated from the gear teeth 111 of the first gear portion 110 of the second agitator gear 100 and thus the engagement between the third gear portion 230 and the first gear portion 110 is released, as illustrated in FIGS. 12A and 12B. As a result, the rotational force of the second agitator gear 100 is no longer transmitted to the detection gear 200 through the first gear portion 110 and the third gear portion 230. However, at this time, the gear teeth 241 of the fourth gear portion 240 of the detection gear 200 engage with the gear teeth 121 of the second gear portion 120 of the second agitator gear 100. As a result, the rotational force of the second agitator gear 100 is transmitted to the detection gear 200 through the second gear portion 120 and the fourth gear portion 240, thereby causing the detection gear 200 to start rotating at a high speed.

When the detection gear 200 rotates at the high speed, the first protrusion 261 is exposed through the opening 31A and contacts the lever 7A at a high speed, as illustrated in FIG. 13A. As a result, the lever 7A is positioned between the light-emitting portion and the light-receiving portion of the optical sensor 7B, and therefore the signal received by the optical sensor 7B is changed. In the present embodiment, the first protrusion 261 contacts the lever 7A while the second gear portion 120 and the fourth gear portion 240 are in engagement with each other.

When the second agitator gear 100 further rotates from the state illustrated in FIG. 13A in the arrow direction R1, the detection gear 200 further rotates in the arrow direction R2. By this further rotation of the detection gear 200, as illustrated in FIG. 13B, the gear teeth 241 of the fourth gear portion 240 of the detection gear 200 are separated from the gear teeth 121 of the second gear portion 120 of the second agitator gear 100. As a result, the engagement between the fourth gear portion 240 and the second gear portion 120 is released, and the detection gear 200 is positioned at the final position illustrated in FIG. 13B. At this time, the rotational force of the second agitator gear 100 is no longer transmitted to the detection gear 200 and, afterward, the detection gear 200 does not rotate even when the second agitator gear 100 rotates.

In the above operation process, the output of the optical sensor 7B is switched four times after the start of rotation of the detection gear 200. The output switching pattern (i.e., any one or any combination of: difference in length of an OFF signal or an ON signal; difference in the number of times of switching; and difference in the switching timing) can be changed by modifying at least one of the number of protrusions which rotate together with the detection gear 200 and the sizes of the protrusions in the rotational direction. By associating in advance the signal pattern with the specification of the developing cartridge 10, the control device CU can identify the specification of the developing cartridge 10.

In a used developing cartridge 10, the detection gear 200 is positioned at the final position, and the leading end of the first protrusion 261 is positioned at substantially the same position as the third protrusion 263 of the above-described unused developing cartridge 10. Thus, in a case where the used developing cartridge 10 is attached to the main body housing 2, the leading end of the first protrusion 261 contacts the lever 7A, thereby enabling the controller CU to determine that the developing cartridge 10 is attached to the laser printer 1. Although a portion of the third protrusion 263 may be exposed through the opening 31A when the detection gear 200 is positioned at the final position, the third protrusion 263 does not contact the lever 7A since the third protrusion 263 is separated away from the first protrusion 261.

According to the above-described developing cartridge 10, the rotational speed of the detection gear 200 can be made different between: a case where the detection gear 200 rotates in a state where the first gear portion 110 of the second agitator gear 100 and the third gear portion 230 of the detection gear 200 are in engagement with each other; and a case where the detection gear 200 rotates in a state where the second gear portion 120 of the second agitator gear 100 and the fourth gear portion 240 of the detection gear 200 are in engagement with each other. Specifically, when the detection gear 200 rotates in a state where the first gear portion 110 and the third gear portion 230 are in engagement with each other, the detection gear 200 can rotate at a low speed; while when the detection gear 200 rotates in a state where the second gear portion 120 and the fourth gear portion 240 are in engagement with each other, the detection gear 200 can rotate at a high speed. As a result, motion of the gear structure can be diversified in response to the diversification of the specification of the developing cartridge 10.

Further, the gear member 210 at the second position is closer to the outer surface 11E of the casing 11 than the gear member 210 at the first position is to the outer surface 11E. Thus, an increase in the size of the developing cartridge 10 in the axial direction can be suppressed in comparison with a configuration where the gear member 210 at the second position is farther from the outer surface 11E of the casing 11 than the gear member 210 at the first position is from the outer surface 11E.

Further, the gear member 210 can smoothly move from the first position to the second position by the inclined third surface 330 of the rib 300. With this configuration, release of engagement between the first gear portion 110 and the third gear portion 230 and engagement between the second gear portion 120 and the fourth gear portion 240 can be smoothly performed.

Further, each of the first gear portion 110 and the second gear portion 120 is provided over the entire circumferential periphery of the second agitator gear 100. Accordingly, the configurations of the first gear portion 110, the second gear portion 120, and the second agitator gear 100 can be made simple. Further, the third gear portion 230 is provided over the circumferential entire periphery of the detection gear 200. Thus, the configurations of the third gear portion 230 and the detection gear 200 can be made simple.

Further, when the gear member 210 is positioned at the second position, the detection gear 200 can rotate from the engagement position to the non-engagement position. Thus, when the detection gear 200 rotates to reach the non-engagement position, the rotation of the detection gear 200 can be stopped.

Further, the developing cartridge 10 includes the coil spring 290 that urges the gear member 210 toward the second position. Accordingly, the gear member 210 can reliably move from the first position to the second position.

Next, a second embodiment will be described. In the second embodiment, components different from those of the first embodiment will be described in detail. The same components as those of the first embodiment are designated with the same reference numerals, and descriptions thereof may be omitted.

Figure 14:
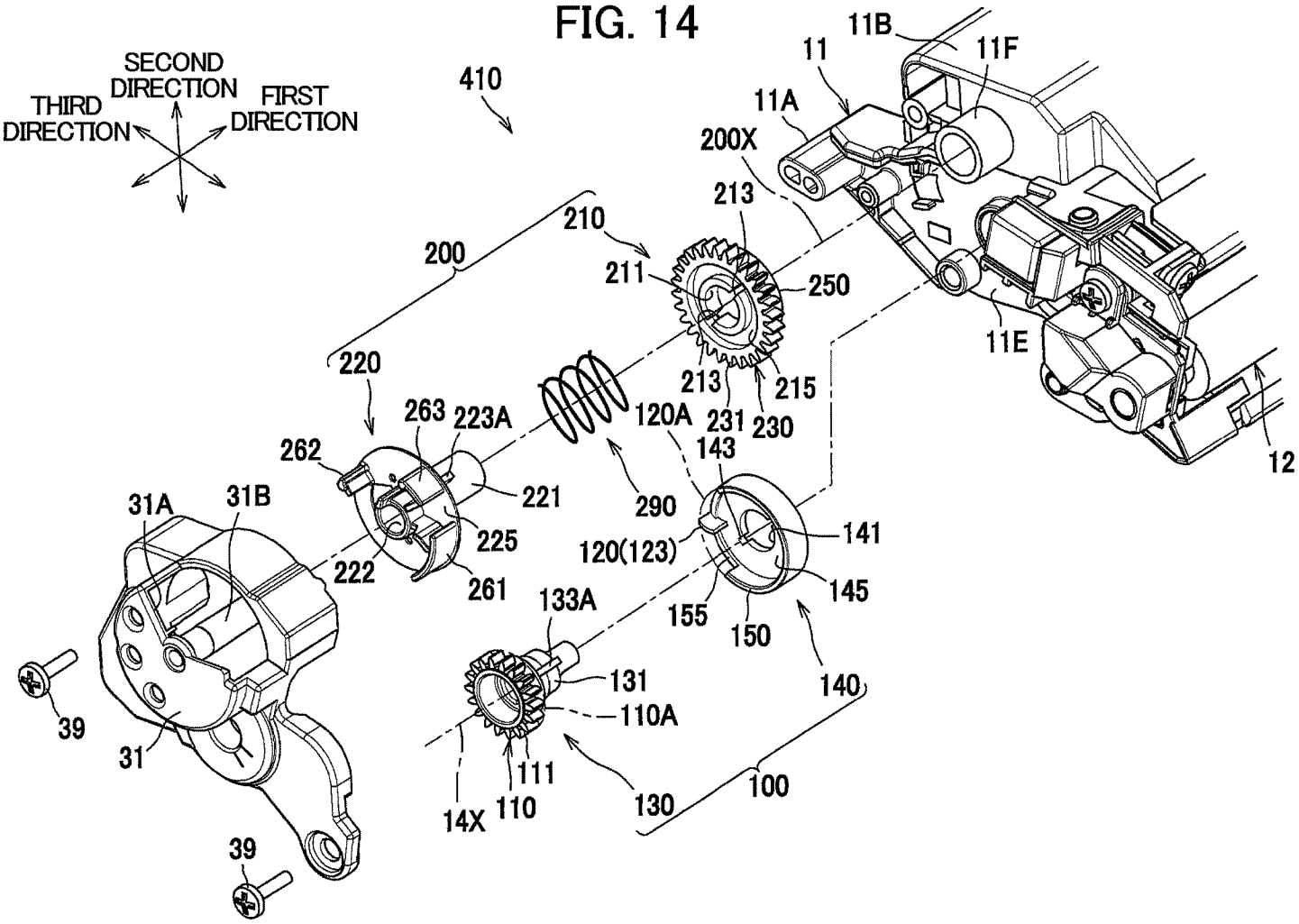
FIG. 14 is an exploded perspective view of parts of a gear structure positioned at another side in the first direction of a casing of a developing cartridge according to a second embodiment.

As illustrated in FIG. 14, in a developing cartridge 410 as an example of the developing cartridge according to the second embodiment, the second agitator gear 100 includes a first gear member 130 and a second gear member 140. The first gear member 130 includes the first gear portion 110. Further, the first gear member 130 includes a shaft portion 131 extending in the axial direction. The shaft portion 131 includes two protruding portions, i.e., a protruding portion 133A and a protruding portion 133B (see FIG. 15C). The protruding portions 133A and 133B protrude outward in the radial direction of the second agitator gear 100. The protruding portions 133A and 133B are disposed, with the shaft portion 131 interposed therebetween.

The second gear member 140 includes a disk portion 145 extending in a direction crossing the axial direction. Preferably, the disk portion 145 extends in a direction orthogonal to the axial direction. The disk portion 145 has a hole 141 through which the shaft portion 131 of the first gear member 130 extends.

The disk portion 145 has recessed portions 143 that are engageable with the protruding portions 133A and 133B of the first gear member 130 in the rotational direction of the second agitator gear 100. Since the shaft portion 131 is inserted into the hole 141, and the recessed portions 143 engage with the protruding portions 133A and 133B, the first gear member 130 and the second gear member 140 can rotate integrally with each other as the second agitator gear 100. The first gear member 130 may be formed integrally with the second gear member 140.

The second gear member 140 includes the second gear portion 120 and a first rib 150. The first rib 150 protrudes in the axial direction. Specifically, the first rib 150 protrudes from the outer circumferential portion of the disk portion 145 in a direction toward the other side of the first direction. Further, the first rib 150 extends along the addendum circle 110A of the first gear portion 110. Specifically, the first rib 150 extends along a portion of the addendum circle 110A. In other words, the first rib 150 extends along a portion of the circumferential periphery of the second agitator gear 100. That is, the second gear member 140 includes a cut portion 155 (i.e., a rib-missing portion) in the circumferential direction of the second agitator gear 100.

The second gear portion 120 includes a third rib 123. The third rib 123 is positioned at the cut portion 155 of the first rib 150. The third rib 123 protrudes in the axial direction. Specifically, the third rib 123 protrudes from a portion of the outer circumferential portion of the disk portion 145 in the direction toward the other side of the first direction, and the portion from which the third rib 123 protrudes corresponds to the cut portion 155. The third rib 123 extends substantially in the radial direction of the second agitator gear 100.

The addendum circle 120A of the second gear portion 120 is greater in diameter than the addendum circle 110A of the first gear portion 110. The addendum circle 120A is a circle with the first axis 14X as a center and with the distance from the first axis 14X to the outside end of the third rib 123 in the radial direction of the second agitator gear 100 as a radius. The outside end of the third rib 123 in the radial direction of the second agitator gear 100 is positioned farther from the first axis 14X in the radial direction of the second agitator gear 100 than the first gear portion 110 is from the first axis 14X.

The detection gear 200 includes the gear member 210 and the rotary member 220. As illustrated in FIG. 15C, the gear member 210 includes the fourth gear portion 240 and a second rib 250. The fourth gear portion 240 and the second rib 250 are positioned at one side of the disk portion 215 in the first direction.

The second rib 250 protrudes in the axial direction. Specifically, the second rib 250 protrudes from the disk portion 215 in a direction toward the one side of the first direction. Further, the second rib 250 extends along the addendum circle 230A of the third gear portion 230. Specifically, the second rib 250 extends along a portion of the addendum circle 230A. In other words, the second rib 250 extends along a portion of the circumferential periphery of the detection gear 200. That is, the gear member 210 includes a cut portion 255 (i.e., a rib-missing portion) in the circumferential direction of the detection gear 200. The second rib 250 contacts the first rib 150 of the second agitator gear 100 in the axial direction when the gear member 210 is positioned at the first position illustrated in FIG. 15C.

The fourth gear portion 240 includes a boss 243. The boss 243 is positioned at the cut portion 255 of the detection gear 200. The boss 243 protrudes in the axial direction. Specifically, the boss 243 protrudes from a portion of the disk portion 215 in the direction toward the one side of the first direction, and the portion from which the boss 243 protrudes corresponds to the cut portion 255. The third rib 123 of the second agitator gear 100 is engageable with the boss 243.

The addendum circle 240A (see FIG. 15B) of the fourth gear portion 240 is smaller in diameter than the addendum circle 230A of the third gear portion 230. The addendum circle 240A is a circle with the second axis 200X as a center and with the distance from the second axis 200X to the outside end of the boss 243 in the radial direction of the detection gear 200 as a radius. The boss 243 is positioned closer to the second axis 200X in the radial direction of the detection gear 200 than the third gear portion 230 is to the second axis 200X.

As described above, the third rib 123 is positioned farther from the first axis 14X in the radial direction of the second agitator gear 100 than the first gear portion 110 is from the first axis 14X, and the boss 243 is positioned closer to the second axis 200X in the radial direction of the detection gear 200 than the third gear portion 230 is to the second axis 200X. Accordingly, when the first gear portion 110 and the third gear portion 230 is in engagement with each other, the detection gear 200 rotates at a low speed, while when the third rib 123 and the boss 243 are in engagement with each other, the detection gear 200 rotates at a high speed.

As illustrated in FIG. 14, the casing 11 includes a tubular portion 11F. The tubular portion 11F protrudes from the outer surface 11E and extends in the first direction. The rotary member 220 is rotatably supported by the casing 11, with the leading end of the tubular portion 221 at the one side in the first direction inserted into the tubular portion 11F.

Figure 15A:
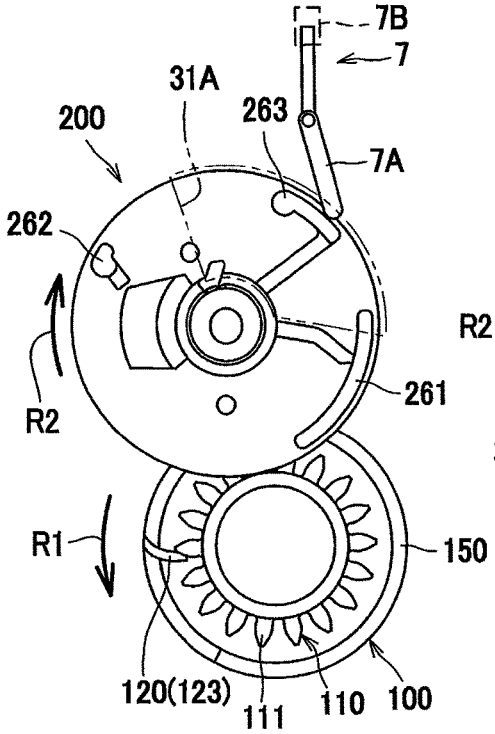
FIG. 15A is a view illustrating a detection gear and a second agitator gear of the developing cartridge, the view illustrating a state where the detection gear is positioned at an initial position.
Figure 15B:
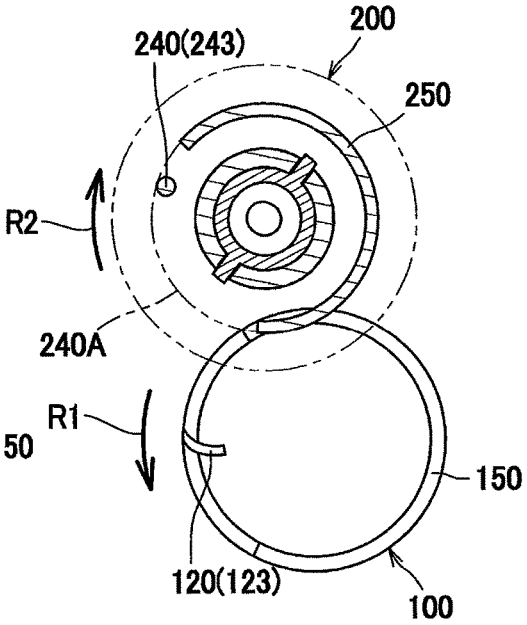
FIG. 15B is a view illustrating the detection gear and the second agitator gear, the view illustrating the state where the detection gear is positioned at the initial position.
Figure 15C:
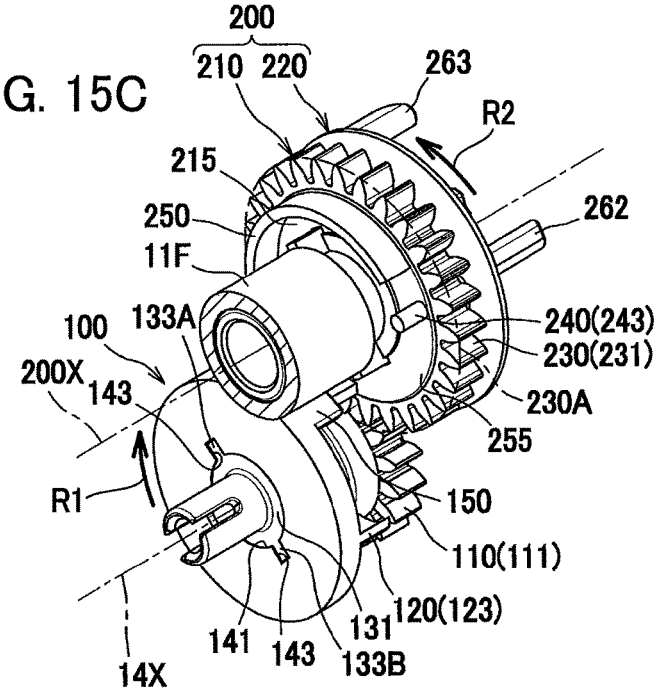
FIG. 15C is a view illustrating the detection gear and the second agitator gear, the view illustrating the state where the detection gear is positioned at the initial position.
Figure 19A:
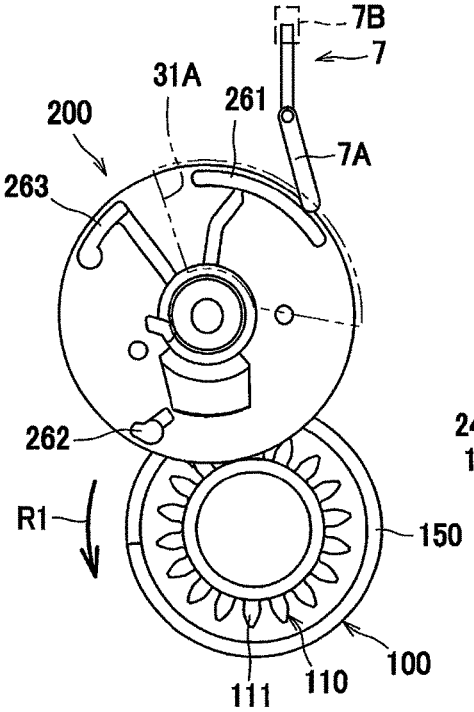
FIG. 19A is a view illustrating the detection gear and the second agitator gear, the view illustrating a state where the detection gear is positioned at a final position.
Figure 19B:
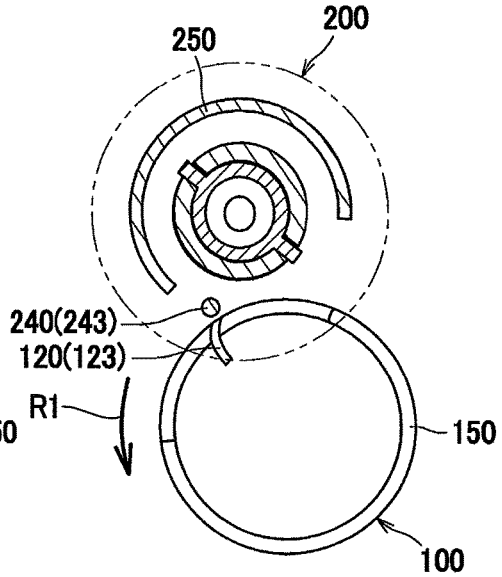
FIG. 19B is a view illustrating the detection gear and the second agitator gear, the view illustrating the state where the detection gear is positioned at the final position.

The detection gear 200 is rotatable about the second axis 200X from the initial position illustrated in FIGS. 15A to 15C to the final position illustrated in FIGS. 19A and 19B. The gear member 210 is movable relative to the rotary member 220 in the axial direction from the first position illustrated in FIG. 15C to the second position illustrated in FIG. 17C while the detection gear 200 rotates from the initial position to the final position.

Functions and effects of the developing cartridge 410 having the above configuration will be described.

As illustrated in FIG. 15A, when the developing cartridge 410 is in an unused state, that is, when the detection gear 200 is positioned at the initial position, the leading end of the third protrusion 263 is exposed through the opening 31A of the second gear cover 31. Thus, when the unused developing cartridge 410 is attached to the laser printer 1, the leading end of the third protrusion 263 contacts the lever 7A. Thus, the lever 7A is positioned between the light-emitting portion and the light-receiving portion of the optical sensor 7B, thereby enabling determination that the developing cartridge 410 is attached to the laser printer 1 to be performed.

As illustrated in FIGS. 15A to 15C, when the second agitator gear 100 rotates in the arrow direction R1, the rotational force of the second agitator gear 100 is transmitted to the detection gear 200 due to engagement between the first gear portion 110 and the third gear portion 230. As a result, the detection gear 200 rotates in the arrow direction R2 at a low speed in accordance with the rotation of the second agitator gear 100. Then, the leading end of the third protrusion 263 does not contact the lever 7A, and the signal received by the optical sensor 7B is changed.

When the detection gear 200 further rotates, the second protrusion 262 is exposed through the opening 31A, and the leading end of the second protrusion 262 contacts the lever 7A at a low speed. Thus, the signal received by the optical sensor 7B is changed. When the detection gear 200 further rotates, the leading end of the second protrusion 262 does not contact the lever 7A, and the signal received by the optical sensor 7B is changed.

In the meantime, the gear member 210 is positioned at the first position, and the second rib 250 is in contact with the first rib 150 of the second agitator gear 100 in the axial direction.

Figure 16A:
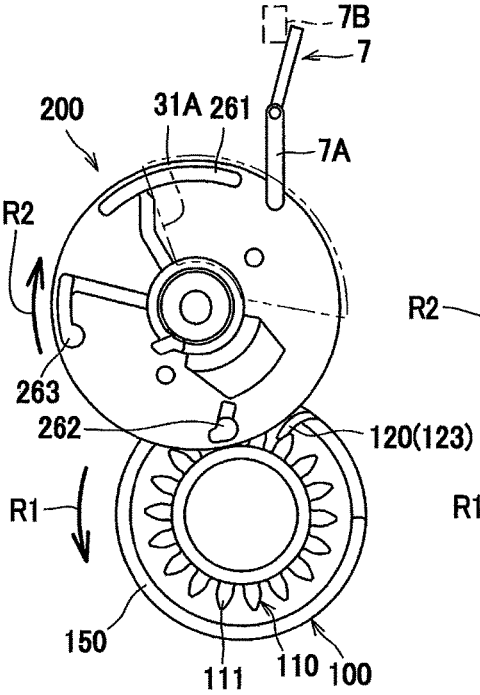
FIG. 16A is a view illustrating the detection gear and the second agitator gear, the view illustrating a state immediately before contact between a first rib of the second agitator gear and a second rib of the detection gear in an axial direction is released.
Figure 16B:
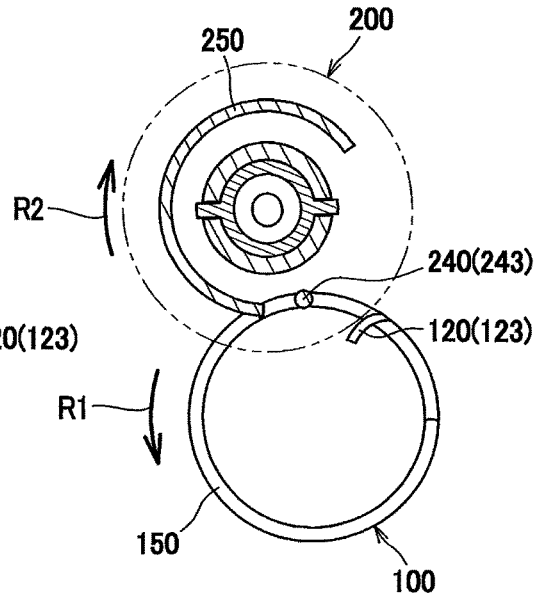
FIG. 16B is a view illustrating the detection gear and the second agitator gear, the view illustrating the state immediately before the contact between the first rib and the second rib in the axial direction is released.

When the detection gear 200 further rotates, the contact between the first rib 150 and the second rib 250 in the axial direction is released from the state illustrated in FIGS. 16A and 16B where the first rib 150 and the second rib 250 is in contact with each other in the axial direction.

Figure 17A:
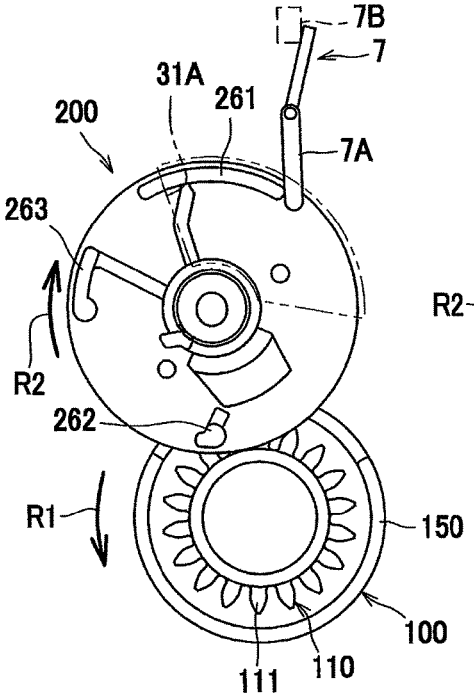
FIG. 17A is a view illustrating the detection gear and the second agitator gear when a gear member of the detection gear moves to reach a second position.
Figure 17B:
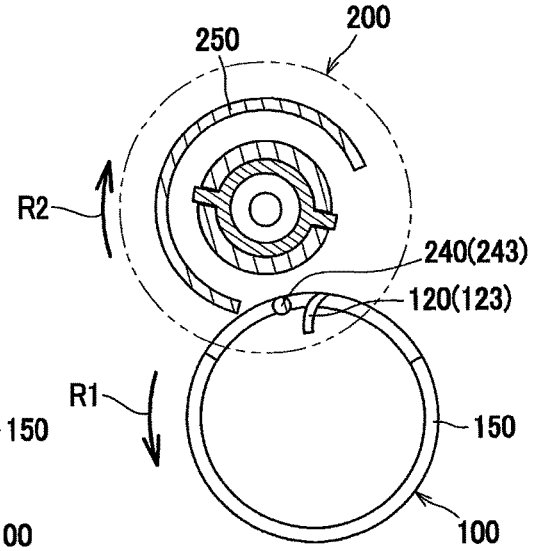
FIG. 17B is a view illustrating the detection gear and the second agitator gear when the gear member moves to reach the second position.
Figure 17C:
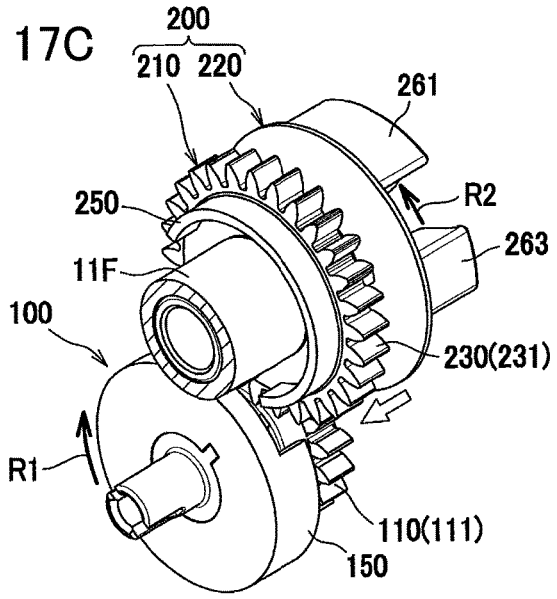
FIG. 17C is a view illustrating the detection gear and the second agitator gear when the gear member moves to reach the second position.

As illustrated in FIGS. 17A to 17C, when the contact in the axial direction between the first rib 150 and the second rib 250 is released by rotation of the second agitator gear 100 and the detection gear 200, the gear member 210 can rotate from the first position to the second position. Specifically, the gear member 210 moves in the axial direction from the first position to the second position by the urging force of the coil spring 290 (see FIG. 14).

Figure 18A:
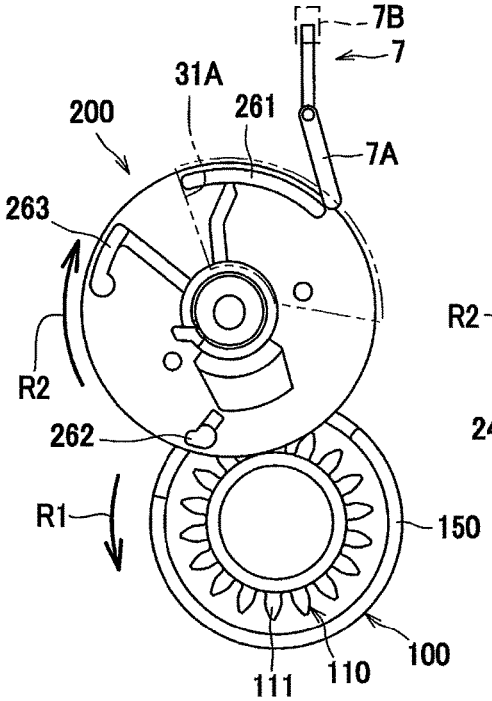
FIG. 18A is a view illustrating the detection gear and the second agitator gear when a third rib of the second agitator gear and a boss of the detection gear engage with each other.
Figure 18B:
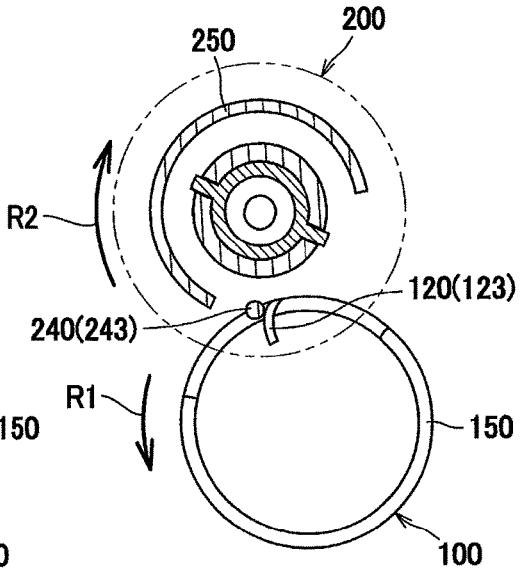
FIG. 18B is a view illustrating the detection gear and the second agitator gear when the third rib and the boss engage with each other.

Upon the movement of the gear member 210 from the first position to the second position, the engagement between the third gear portion 230 and the first gear portion 110 is released. At this time, as illustrated in FIGS. 18A and 18B, the third rib 123 of the second gear portion 120 engage with the boss 243 of the fourth gear portion 240 of the detection gear 200 by rotation of the second agitator gear 100. As a result, the detection gear 200 starts rotating at a high speed. In the meantime, the first protrusion 261 is exposed through the opening 31A by rotation of the detection gear 200.

Then, when the detection gear 200 starts rotating at a high speed, the leading end of the first protrusion 261 contacts the lever 7A at a high speed. As a result, the signal received by the optical sensor 7B is changed.

When the detection gear 200 further rotates, the engagement between the third rib 123 of the second gear portion 120 and the boss 243 of the fourth gear portion 240 is released as illustrated in FIGS. 19A and 19B, and the detection gear 200 is positioned at the final position. When the detection gear 200 is positioned at the final position, the rotational force of the second agitator gear 100 is no longer transmitted to the detection gear 200, and the detection gear 200 is stopped.

According to the above-described developing cartridge 410 as well, the rotational speed of the detection gear 200 can be changed depending on the engagement state. That is, when the detection gear 200 rotates in a state where the first gear portion 110 and the third gear portion 230 are in engagement with each other, the detection gear 200 can rotate at a low speed; while when the detection gear 200 rotates in a state where the second gear portion 120 and the fourth gear portion 240 are in engagement with each other, the detection gear 200 can rotate at a high speed. As a result, motion of the gear structure can be diversified.

In the present embodiment, the second gear portion 120 and the fourth gear portion 240 include the third rib 123 and boss 243, respectively. However, the second gear portion 120 and the fourth gear portion 240 may include the boss and the third rib, respectively.

While the embodiments of the present disclosure have been described, the present disclosure is not limited to these embodiments, and various modifications can be made thereto without departing from the scope of the disclosure.

In the above embodiments, the first protrusion 261, the second protrusion 262, and the third protrusion 263 are integrally formed with the detection gear 200. Alternatively, each of the first protrusion 261, the second protrusion 262, and the third protrusion 263 may be a different component separately formed from the detection gear 200.

In this case, the detection gear may have a cam. Specifically, the detection gear may have such a configuration that the detection gear moves in accordance with rotation of the coupling to transit between a first state where the cam and the protrusion contact each other and a second state where the cam and the protrusion are separated from each other, and the protrusions are moved by the transition of the detection gear between the first state and the second state. For example, the protrusion may linearly move. The protrusion may have any configuration as long as the protrusion can move the lever 7A.

In the above embodiments, the leading end of the second protrusion 262 is smaller in length in the rotational direction of the detection gear 200 than the first protrusion 261 and the third protrusion 263. However, the length of the leading end of the second protrusion 262 is not limited to the above configuration. For example, the length of the leading end of the second protrusion 262 may be substantially equal to or greater than the length of the leading end of the first protrusion 261 or the length of the leading end of the third protrusion 263. Further, a plurality of the second protrusions 262 may be positioned between the first protrusion 261 and the third protrusion 263 in the rotational direction of the detection gear 200.

The third protrusion 263 need not contact the lever 7A when the detection gear 200 is positioned at the initial position. The first protrusion 261 need not contact the lever 7A when the detection gear 200 is positioned at the final position. At least one of the second protrusion 262 and the third protrusion 263 may be omitted from the developing cartridge 10. The first protrusion 261 may contact the lever 7A when the detection gear 200 is positioned at the initial position. The first protrusion 261 may contact the lever 7A in the middle of rotation of the detection gear 200 from the initial position to the final position.

In the above embodiments, the first gear portion 110 is provided over the entire circumferential periphery of the second agitator gear 100. Alternatively, the first gear portion 110 may be provided only at a portion of the circumferential periphery of the second agitator gear 100. The same is true with respect to the second gear portion 120. Further, although the third gear portion 230 is provided over the entire circumferential periphery of the detection gear 200, the third gear portion 230 may be provided only at a portion of the circumferential periphery of the detection gear 200.

In the above embodiments, the first gear portion 110 and the third gear portion 230 are in engagement with each other when the gear member 210 is positioned at the first position. However, the configurations of the first gear portion 110 and the third gear portion 230 are not limited to the above-described configuration. For example, when the gear member 210 is positioned at the first position, the detection gear 200 may be rotatable from a position where the first gear portion 110 and the third gear portion 230 do not engage with each other to a position where the first gear portion 110 and the third gear portion 230 are in engagement with each other. That is, when the gear member 210 is positioned at the first position, the first gear portion 110 and the third gear portion 230 need not always be in engagement with each other.

Figure 20A:
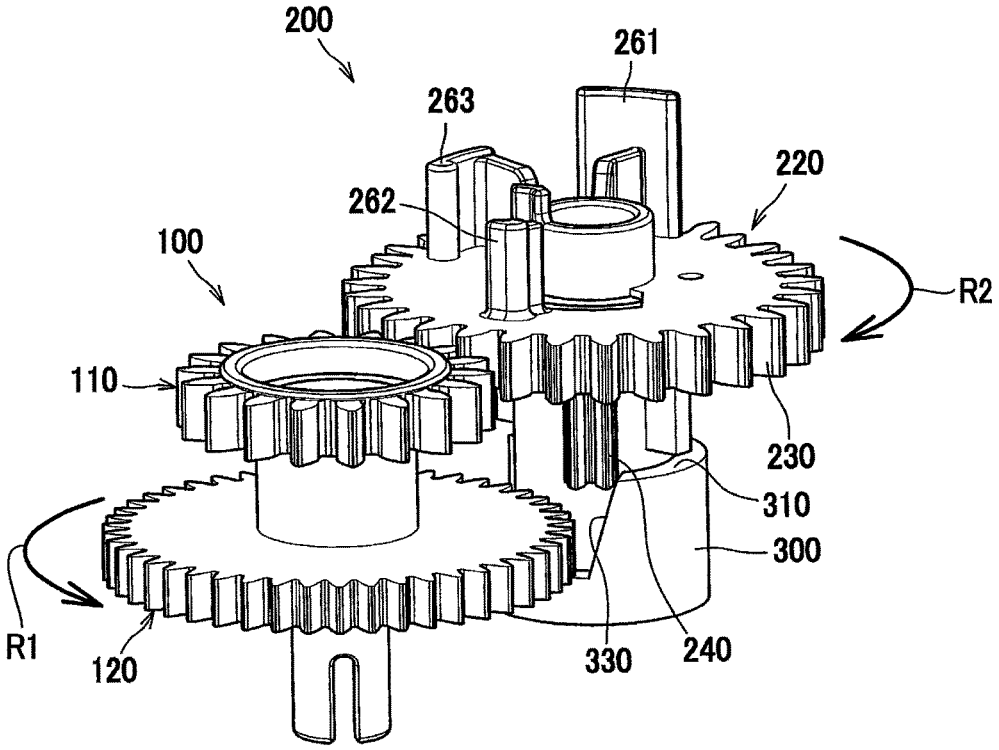
FIG. 20A is a view illustrating a detection gear of a developing cartridge according to a modified example of the first embodiment.
Figure 20B:
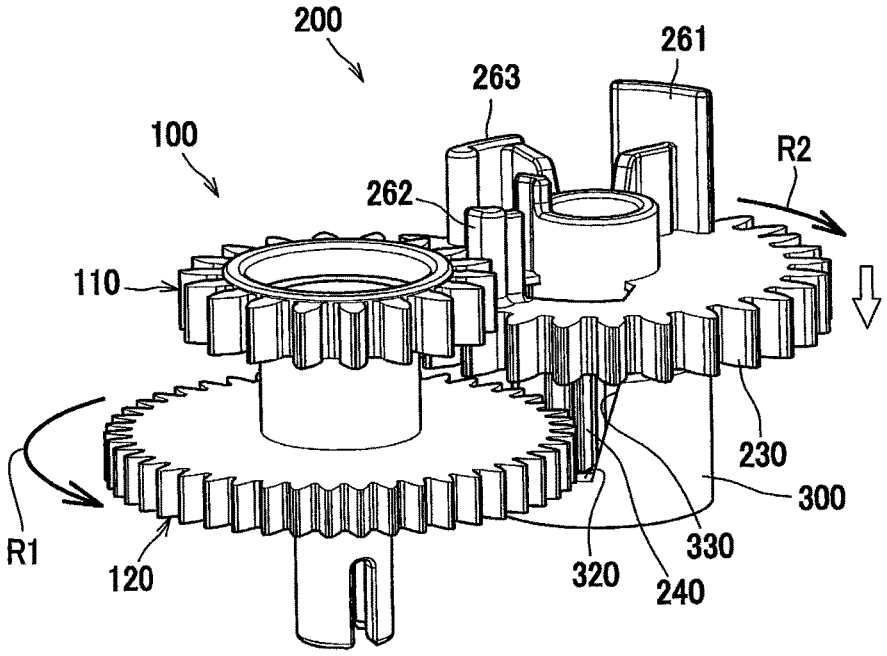
FIG. 20B is a view illustrating the detection gear of the developing cartridge according to the modified example of the first embodiment.

In the above embodiments, the gear member 210 is movable from the first position to the second position. However, the configuration of the gear member 210 is not limited to the above-described configuration. In other words, the configuration of the detection gear 200 is not limited to the configuration in which a portion of the detection gear 200 including the third gear portion 230 and the fourth gear portion 240 is movable from the first position to the second position. For example, as illustrated in FIGS. 20A and 20B, the whole of the detection gear 200 may be movable, together with the third gear portion 230 and the fourth gear portion 240, from the first position illustrated in FIG. 20A to the second position illustrated in FIG. 20B. In this case, for example, the first protrusion 261 desirably has a length in the first direction enough to contact the lever 7A even after movement of the detection gear 200 from the first position to the second position. Specifically, the length in the first direction of the first protrusion 261 is desirably greater than the lengths in the first direction of the second protrusion 262 and the third protrusion 263.

In the above embodiments, the first gear portion 110 includes the gear teeth 111. Alternatively, the first gear portion 110 may include a friction member in place of the gear teeth 111 and transmit a rotational force by a friction transmission. The friction member is, for example, rubber. The same is true with respect to the second gear portion 120, the third gear portion 230, and the fourth gear portion 240.

In the above embodiments, when the third gear portion 230 is positioned at the second position, the third gear portion 230 is closer to the outer surface 11E of the casing 11 in the axial direction (i.e., the first direction) than when the third gear portion 230 is positioned at the first position. That is, the third gear portion 230 at the second position is closer to the outer surface 11E of the casing 11 in the axial direction (i.e., the first direction) than the third gear portion 230 at the first position is to the outer surface 11E. Alternatively, when the third gear portion 230 is positioned at the second position, the third gear portion 230 is farther from the outer surface 11E of the casing 11 in the axial direction (i.e., the first direction) than when the third gear portion 230 is positioned at the first position.

Further, in the above embodiments, when the fourth gear portion 240 is positioned at the second position, the fourth gear portion 240 is closer to the outer surface 11E of the casing 11 in the axial direction (i.e., the first direction) than when the fourth gear portion 240 is positioned at the first position. That is, the fourth gear portion 240 at the second position is closer to the outer surface 11E of the casing 11 in the axial direction (i.e., the first direction) than the fourth gear portion 240 at the first position is to the outer surface 11E. Alternatively, when the fourth gear portion 240 is positioned at the second position, the fourth gear portion 240 is farther from the outer surface 11E of the casing 11 in the axial direction (i.e., the first direction) than when the fourth gear portion 240 is positioned at the first position.

In the above embodiments, the second agitator gear 100 is mounted to the agitator shaft 14A of the agitator 14. Alternatively, the second agitator gear 100 may be mounted to the shaft of the casing 11.

In the above embodiment, the coil spring 290 serves as the urging member. Alternatively, any spring other than the coil spring may be used as the urging member. Further, any member other than a spring may be used as the urging member as long as the member has elasticity. For example, rubber may be used as the urging member. Further, the urging member may be omitted from the developing cartridge 10.

In the above-described embodiments, the initial position is taken as an example of the first rotational position. Alternatively, the first rotational position may be a position other than the initial position. For example, the first rotational position may be the third rotational position described in the above embodiments.

In the above-described embodiments, the final position is taken as an example of the second rotational position. Alternatively, the second rotational position may be a position other than the final position. For example, the second rotational position may be the fourth rotational position described in the above embodiments.

In the above-described embodiments, the developing cartridge 10 is separately formed from the photosensitive cartridge 5. Alternatively, the developing cartridge 10 may be integrally formed with the photosensitive cartridge 5.

In the above-described embodiments, the monochrome laser printer 1 is taken as an example of the image forming apparatus. However, the image forming apparatus may be a color image forming apparatus, an apparatus that performs exposure using an LED, a copier, or a multifunction machine.

The elements in the embodiments and modifications thereof may be arbitrarily combined in the implementation.

What is claimed is:

1. A developing cartridge comprising:

a casing configured to accommodate therein developing agent;

a first gear rotatable about a first axis extending in a first direction, the first gear being positioned at an outer surface of the casing, the first gear including:

a first gear portion having an addendum circle; and a second gear portion positioned at a position different from a position of the first gear portion in the first direction, the second gear portion having an addendum circle greater than the addendum circle of the first gear portion;

a second gear rotatable about a second axis extending in the first direction from a first rotational position to a second rotational position with rotation of the first gear, the second gear being positioned at the outer surface, the second gear including:

a third gear portion engageable with the first gear portion and having an addendum circle; and a fourth gear portion engageable with the second gear portion, the fourth gear portion being positioned at a position different from a position of the third gear portion in the first direction, the fourth gear portion having an addendum circle smaller than the addendum circle of the third gear portion; and a first protrusion protruding in the first direction and movable together with the second gear, wherein the third gear portion and the fourth gear portion are movable relative to the casing from a first position to a second position during rotation of the second gear from the first rotational position to the second rotational position, wherein, in a case where the third gear portion and the fourth gear portion are positioned at the first position, the first gear portion and the third gear portion engage with each other and the second gear portion and the fourth gear portion do not engage with each other, and wherein, in a case where the third gear portion and the fourth gear portion are positioned at the second position, the second gear portion and the fourth gear portion engage with each other and the first gear portion and the third gear portion do not engage with each other.

2. The developing cartridge according to claim 1, wherein the third gear portion at the second position is positioned closer to the outer surface than the third gear portion at the first position is to the outer surface, and wherein the fourth gear portion at the second position is positioned closer to the outer surface than the fourth gear portion at the first position is to the outer surface.

3. The developing cartridge according to claim 1, wherein the second gear portion is positioned closer to the outer surface in the first direction than the first gear portion is to the outer surface, and wherein the fourth gear portion is positioned closer to the outer surface in the first direction than the third gear portion is to the outer surface.

4. The developing cartridge according to claim 1, wherein the fourth gear portion protrudes in the first direction toward the outer surface, wherein the casing includes a rib protruding in the first direction toward the third gear portion, the rib extending along a portion of the addendum circle of the fourth gear portion, and the rib having a first surface which is an end surface in the first direction, wherein, in a case where the third gear portion and the fourth gear portion are positioned at the first position, a leading end of the fourth gear portion is in contact with the first surface, and wherein, in a case where the contact between the leading end of the fourth gear portion and the first surface is released by the rotation of the second gear, the third gear portion and the fourth gear portion are movable from the first position to the second position.

5. The developing cartridge according to claim 4, wherein the casing includes:

a second surface in contact with the leading end of the fourth gear portion in a case where the third gear portion and the fourth gear portion are positioned at the second position, the second surface being positioned at a position different from a position of the first surface in the first direction, the second surface being positioned away from the first surface in a rotational direction of the second gear; and a third surface connecting the first surface and the second surface, the third surface being inclined from the first surface to the second surface, and wherein, during movement of the fourth gear portion from the first position to the second position, a contacting state of the leading end of the fourth gear portion is changed from a state where the leading end of the fourth gear portion is in contact with the first surface to a state where the leading end of the fourth gear portion is in contact with the third surface, and is further changed from the state where the leading end of the fourth gear portion is in contact with the third surface to a state where the leading end of the fourth gear portion is in contact with the second surface.

6. The developing cartridge according to claim 4, wherein the second gear portion is positioned away from the first gear portion in the first direction.

7. The developing cartridge according to claim 1, wherein the first gear includes a first rib extending along a portion of the addendum circle of the first gear portion, wherein the second gear includes a second rib extending along a portion of the addendum circle of the third gear portion, the second rib being in contact with the first rib in the first direction in a case where the third gear portion and the fourth gear portion are positioned at the first position, and wherein the third gear portion and the fourth gear portion are movable from the first position to the second position in a case where the contact between the first rib and the second rib in the first direction is released by rotation of the first gear and the second gear.

8. The developing cartridge according to claim 1, wherein the first gear portion is provided along a circumferential periphery of the first gear.

9. The developing cartridge according to claim 8, wherein the first gear portion is provided over an entire circumferential periphery of the first gear.

10. The developing cartridge according to claim 1, wherein the third gear portion is provided along a circumferential periphery of the second gear.

11. The developing cartridge according to claim 10, wherein the third gear portion is provided over an entire circumferential periphery of the second gear.

12. The developing cartridge according to claim 1, wherein the first gear portion includes a gear tooth, and wherein the third gear portion includes a gear tooth.

13. The developing cartridge according to claim 1, wherein the second gear portion includes one or more of gear teeth, and wherein the fourth gear portion includes one or more of gear teeth.

14. The developing cartridge according to claim 13, wherein the second gear portion is provided along a circumferential periphery of the first gear.

15. The developing cartridge according to claim 14, wherein the second gear portion is provided over an entire circumferential periphery of the first gear.

16. The developing cartridge according to claim 1, wherein one of the second gear portion and the fourth gear portion includes a boss protruding in the first direction, and wherein remaining one of the second gear portion and the fourth gear portion includes a third rib protruding in the first direction.

17. The developing cartridge according to claim 1, wherein the second gear is movable from the first position to the second position together with the third gear portion and the fourth gear portion.

18. The developing cartridge according to claim 1, wherein the first protrusion is rotatable together with the second gear.

19. The developing cartridge according to claim 1, wherein the second gear includes the first protrusion.

20. The developing cartridge according to claim 1, further comprising a second protrusion protruding in the first direction and movable together with the second gear, the second protrusion being positioned away from the first protrusion in a rotational direction of the second gear.

21. The developing cartridge according to claim 20, wherein the second protrusion is rotatable together with the second gear.

22. The developing cartridge according to claim 20, wherein the second gear includes the second protrusion.

23. The developing cartridge according to claim 1, wherein, in a case where the third gear portion and the fourth gear portion are positioned at the second position, the second gear is rotatable from an engagement position where the second gear portion and the fourth gear portion are in engagement with each other to a non-engagement position where the second gear portion and the fourth gear portion do not engage with each other.

24. The developing cartridge according to claim 1, further comprising an urging member configured to urge the third gear portion and the fourth gear portion toward the second position.

25. The developing cartridge according to claim 24, wherein the second gear includes:

a gear member including the third gear portion and the fourth gear portion, the gear member being movable from the first position to the second position together with the third gear portion and the fourth gear portion; and a rotary member including the first protrusion and rotatable together with the gear member, and wherein the urging member is a coil spring configured to urge the gear member toward the second position, the urging member being positioned between the gear member and the rotary member in the first direction.

26. The developing cartridge according to claim 1, further comprising an agitator configured to agitate the developing agent and rotatable about the first axis, the agitator including a shaft extending in the first direction, wherein the first gear is mounted to the shaft, and is rotatable together with the agitator.

27. The developing cartridge according to claim 1, further comprising a developing roller rotatable about a third axis extending in the first direction.

* * * * *